US007903078B2

(12) United States Patent
Tsuchi

(10) Patent No.: US 7,903,078 B2
(45) Date of Patent: Mar. 8, 2011

(54) DATA DRIVER AND DISPLAY DEVICE

(75) Inventor: Hiroshi Tsuchi, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 781 days.

(21) Appl. No.: 11/979,715

(22) Filed: Nov. 7, 2007

(65) Prior Publication Data

US 2008/0111628 A1 May 15, 2008

(30) Foreign Application Priority Data

Nov. 10, 2006 (JP) ..... 2006-305081

(51) Int. Cl.
*G09G 5/00* (2006.01)

(52) U.S. Cl. ..... 345/100; 330/180

(58) Field of Classification Search ..... 345/100
See application file for complete search history.

(56) References Cited

U.S. PATENT DOCUMENTS

| | | | |
|---|---|---|---|
| 4,570,128 | A | 2/1986 | Monticelli |
| 7,119,802 | B2 | 10/2006 | Suyama et al. |
| 7,317,442 | B2 | 1/2008 | Nakai et al. |
| 7,369,075 | B2 | 5/2008 | Ishii et al. |
| 2007/0171177 | A1 * | 7/2007 | Kim et al. |
| 2008/0024420 | A1 | 1/2008 | Nakai et al. |

FOREIGN PATENT DOCUMENTS

| | | |
|---|---|---|
| JP | 61-296805 | 12/1986 |
| JP | 6-91379 | 11/1994 |
| JP | 10-187100 | 7/1998 |
| JP | 10-260664 | 9/1998 |
| JP | 11-150427 | 6/1999 |
| JP | 2003-216256 | 7/2003 |
| JP | 2004-120564 | 4/2004 |
| JP | 2004-138820 | 5/2004 |
| JP | 2004-271930 | 9/2004 |
| JP | 2005-328464 | 11/2005 |
| JP | 2006-197532 | 7/2006 |

* cited by examiner

*Primary Examiner* — Richard Hjerpe
*Assistant Examiner* — Sepideh Ghafari
(74) *Attorney, Agent, or Firm* — McGinn IP Law Group, PLLC

(57) ABSTRACT

Disclosed is a data driver including a zero compensation resistor connected in series with a phase compensation capacitor between an output node of an input differential amplification stage and an output node of a succeeding amplification stage, and a control circuit that controls to switch a resistance value of the zero compensation resistor. The control circuit switches the resistance value of the zero compensation resistor to a first resistance value or a second resistance value larger than the first resistance value in response to turning off or on of an output switch that controls connection between the output terminal of an amplifying circuit and a data line.

20 Claims, 14 Drawing Sheets

FIG. 2

| | ONE DATA PERIOD | |
|---|---|---|
| | T1 | T2 |
| S1 | SW10 OFF | SW10 ON |
| S2 | SMALL RESISTANCE VALUE R1 | LARGE RESISTANCE VALUE R1 |

DATA DRIVER AND DISPLAY DEVICE

REFERENCE TO RELATED APPLICATION

The present application is claiming the priority of the earlier Japanese patent application No. 2006-305081 filed on Nov. 10, 2006, the entire disclosure thereof being incorporated herein by reference thereto.

FIELD OF THE INVENTION

The present invention relates to a data driver and a display device using the data driver.

BACKGROUND OF THE INVENTION

Recently, there has been an increasing demand for liquid crystal display devices for use in large-screen liquid crystal TV sets as well as for use in portable telephones (such as mobile phones or cellular phones), notebook PCs, and monitors. As these liquid crystal display devices, an active matrix driving liquid crystal display device capable of performing high-definition display is employed. First, referring to FIG. 11, a typical configuration of the active matrix driving liquid crystal display device will be outlined. FIG. 11 schematically shows a main configuration connected to a pixel in a liquid crystal display unit, using an equivalent circuit.

Generally, a display unit 960 of the active matrix driving system liquid crystal display device includes a semiconductor substrate, an opposing substrate, and a liquid crystal sealed in between these two substrates by opposing these two substrates. On the semiconductor substrate, transparent pixel electrodes 964 and thin-film transistors (TFTs) 963 are arranged in a matrix form (of 1280×3 pixel rows×1024 pixel columns in the case of a color SXGA panel, for example). One transparent electrode 967 is formed on an entire surface of the opposing substrate.

Turning ON and OFF of a TFT 963 having a switching function is controlled by a scan signal. When the TFT 963 is turned on, a gray scale signal voltage corresponding to a video data signal is applied to a corresponding pixel electrode 964. Transmittance of the liquid crystal is changed by a potential difference between each pixel electrode 964 and the opposing substrate electrode 967, and even after the TFT 963 has been turned off, the potential difference is held by a liquid crystal capacitor 965 and an auxiliary capacitor 966 for a certain period, thereby displaying an image.

On the semiconductor substrate, data lines 962 and scan lines 961 are wired in the form of a grid (in which 1280×3 data lines and 1024 scan lines are arranged in the case of the color SXGA panel described above). A data line 962 sends a plurality of level voltages (gray scale signal voltages) applied to each pixel electrode 964, and a scan line 961 sends the scan signal. Due to a capacitance produced at an intersection between each of the scan lines 961 and each of the data lines 962 and a liquid crystal capacitance sandwiched between the semiconductor substrate and the opposing substrate, the scan lines 961 and the data lines 962 have become a large capacitive load.

The scan signal is supplied to a scan line 961 from a gate driver 970, and a grayscale signal voltage is supplied to each pixel electrode 964 from a data driver 980 through a data line 962. The gate driver 970 and the data driver 980 are controlled by a display controller 950. A clock CLK, a control signal, and a supply voltage that are necessary are supplied from the display controller 950 to each of the gate driver 970 and the data driver 980, and video data is supplied to the data driver 980. Currently, digital data has become the mainstream of the video data.

Rewriting of data of one screen is performed in one frame period (of approximately 0.017 seconds, usually). Data is successively selected every pixel row (every line) by each scan line, and a gray scale voltage signal is supplied from each data line within a selection period.

While the gate driver 970 should supply the scan signal of at least binary values, the data driver 980 needs to drive a data line by the gray scale voltage signal of multi-valued levels corresponding to the number of gray scales. For this reason, the data driver 980 includes a digital-to-analog converter circuit (DAC) comprising a decoder that converts the video data to an analog voltage and an output amplifier that amplifies the analog voltage and outputs the amplified analog voltage to a corresponding data line 962.

FIG. 12A shows a configuration in which an output buffer of the data driver 980 in FIG. 11 is connected to the data line 962. An output switch SW10 is provided between an output end N9 of an output buffer 90 and a driver output terminal P09 to which the data line 962 is connected. The output switch SW10 is generally provided at the data driver of the liquid crystal display device in order to prevent transition noise induced within a circuit such as the decoder at a time of change in video data from being transmitted to the data line.

FIG. 12B is a graph showing a control signal S1 that controls turning on/off of the output switch SW10 and a state of the switch SW10. Referring to FIG. 12B, a period T1 and a period T2 are provided in one data period. During the period T1 from a start of the one data period, the output switch SW1 is turned off, and transmission of an output signal of the output buffer 90 to the data line 962 is cut off. Then, in the period T2, the output switch SW10 is turned on, and an output signal of the amplifying circuit (amplifier circuit) 90 is output to the data line. The period T1 is set to a period in accordance with a convergence time of the transition noise.

As the output buffer in FIG. 12A, an amplifier circuit having a well-known voltage follower configuration may be employed. The amplifier circuit 90 in FIG. 12A includes a current source M15 which has a first terminal connected to a low voltage power supply VSS, a differential pair formed of N-channel transistors (N-channel MOS transistors) M11 and M12 which have coupled sources connected to a second terminal of the current source M15, a current mirror which is composed of P-channel transistors (P-channel MOS transistors) M13 and M14 connected between an output pair of the differential pair (M11, M12) and a high voltage power supply VDD, a P-channel transistor M16 which has a gate connected to an output terminal node N12 of the current mirror (M13, M14), a source connected to the high voltage power supply VDD, and a drain connected to the amplifier output terminal N9, and a current source M17 which is connected between the low voltage power supply VSS and the amplifier output terminal N9. In this specification, a differential pair formed of transistors Ma and Mb is expressed by a differential pair (Ma, Mb). A current mirror formed of transistors Mc and Md is expressed by a current mirror (Mc, Md).

In the amplifier circuit 90, an inverting-input terminal (a gate of the transistor M11) of the differential pair (M11, M12) is connected to the amplifier output terminal N9. A voltage Vin selected by the decoder (not shown) is supplied to a non-inverting input terminal (a gate of the transistor M12) of the differential pair (M11, M12, according to video data.

Between the gate (node N12) of the P-channel transistor M16 and the drain (amplifier output terminal N9) of the P-channel transistor M16, a phase compensation capacitor C1 and a zero compensation resistor R1 are connected in series. By inserting the zero compensation resistor R1 in series with the phase compensation capacitor C1, zero is created in a frequency characteristic, a band is improved, and a phase margin is increased, thereby stabilizing an operation of the amplifier. This arrangement is effective for reducing a capacitance value (accordingly a size) of the phase compensation capacitor C1 with an area thereof within a chip being comparatively large.

The output switch SW10 that is ON/OFF controlled by the control signal S1 is connected between the amplifier output terminal N9 of the amplifier circuit 90 and the data line 962.

The number of the amplifier circuits 90 provided at the data driver 980 in FIG. 11 corresponds to the number of outputs. Thus, it is important to configure the amplifier circuit 90 with a saved area in a multi-output data driver LSI, in order to achieve cost reduction.

FIG. 13 is a diagram showing another configuration of an amplifier that can be used as the amplifier circuit 90 in FIG. 12A. FIG. 13 is the diagram showing a configuration of an AB-class output circuit disclosed in Patent Document 2 listed later. Referring to FIG. 13, an output stage of this AB-class output circuit includes a P-channel transistor M85 connected between a high voltage power supply VDD and an output terminal Vout and an N-channel transistor M86 connected between the output terminal Vout and a low voltage power supply VSS. The output stage is equipped with high charging and discharging capabilities for the output terminal Vout. A gate NP1 of the P-channel transistor M85 is connected to an output terminal of a driver 89 that receives an input signal Vin, and performs a charging operation of an output Vout of the amplifier. A change in the input signal Vin is transferred to a gate NN1 of the N-channel transistor M86 via an intermediate stage (M81, M82), and the N-channel transistor M86 performs a discharging operation of the output Vout of the amplifier.

The intermediate stage includes a P-channel floating current source M81 and an N-channel floating current source M82, and current sources M83 and M84. Bias voltages BP8 and BN8 are supplied to gates of the p-channel floating current source M81 and the N-channel floating current source M82, respectively, and the P-channel floating current source M81 and the N-channel floating current source M82 are connected between the gates (NP1, NN1) of the transistors M85 and M86. The current source M83 is connected between the high voltage power supply VDD and the gate NP1 of the P-channel transistor M85. The current source M84 is connected between the low voltage power supply VSS and the gate NN1 of the N-channel transistor M86. A sum of currents of the floating current sources M81 and M82 is set to be substantially equal to a current of each of the current sources M83 and M84.

An operation of the AB-class output circuit in FIG. 13 will be described below. When a potential at the terminal NP1 changes to low in response to an input voltage Vin, the P-channel transistor M85 performs the charging operation. Immediately after the change at the terminal NP1, a current of the N-channel floating current source M82 does not change. However, a current of the P-channel floating current source M81 is reduced. Thus, a potential at the terminal NN1 changes to low, so that the discharging operation of the N-channel transistor M86 is stopped. For this reason, the AB-class output circuit in FIG. 13 can perform the charging operation at high speed. When the potential at the terminal NN1 changes to low, the current of the N-channel floating current source M82 begins to increase. Thus, the potential at the terminal NN1 gently rises again after having changed to low temporarily, and becomes close to a potential in a steady state.

On the other hand, when the potential at the terminal NP1 changes to high according to the input voltage Vin, the charging operation of the P-channel transistor M85 is stopped. Though the current of the N-channel floating current source M82 does not change immediately after the change at the terminal NP1, the current of the P-channel floating current source M81 increases. Thus, the potential at the terminal NN1 changes to high, so that the N-channel transistor M86 performs the discharging operation. For this reason, the AB-class output circuit in FIG. 13 can perform the discharging operation at high speed.

When a relationship between the sum of the currents of the floating current sources M81 and M82 and the current of each of the current sources M83 and M84 is maintained with respect to an idling current (a static consumption current) of the intermediate stage, a current value of each of the current sources can be sufficiently reduced.

When the amplifier circuit 90 in FIG. 12A is compared with the AB-class output circuit in FIG. 13, discharging capability of the amplifier circuit 90 in FIG. 12A depends on a current value of the current source M17. In order to implement a high-speed discharging operation, the current value of the current source M17 must be increased.

On contrast therewith, though the current flows through the floating current sources M81 and M82 and the current sources M83 and M84 in the intermediate stage of the AB-class output circuit in FIG. 13, a value of the current that flows through floating current sources M81 and M82 and the current sources M83 and M84 is sufficiently small. The high-speed discharging operation is therefore possible even if the current value is particularly increased. That is, the AB-class output circuit in FIG. 13 is suitable when a display panel with a large load capacitance is driven with lower power consumption.

Though the phase compensation capacitor and the zero compensation resistor are not written down in the AB-class output circuit in FIG. 13, a series circuit of the phase compensation capacitor C and the zero compensation resistor R1 may be connected between the output node NP1 (gate of the P-channel transistor M85) of the driver 89 and the output terminal Vout, for use.

FIG. 14 is a diagram showing a configuration of an operational amplifier in Patent Document 2, which will be listed below. In the configuration in FIG. 14, in order to cause the operational amplifier to perform a stable operation in two different gain states, on-off control is performed over a switch S1 connected in series with a phase compensation capacitor C1 and a switch S2 connected in series with a phase compensation capacitor C4, thereby switching a capacitance value of each of the phase compensation capacitors according to each of the states. By switching a value of each of the capacitors according to each of the two different gain states, the operational amplifier is stably operated in each of the states.

[Patent Document 1]

JP Patent Kokoku Publication No. JP-B-6-91379 (FIG. 1)

[Patent Document 2]

JP Patent Kokai Publication No. JP-A-61-296805 (FIG. 1)

SUMMARY OF THE DISCLOSURE

The disclosure of the above-mentioned Patent Documents 1 and 2 is herein incorporated by reference thereto. The following analysis is given by the present invention.

It is desirable that a data driver of a liquid crystal display device can be extensively used in common among various display panels having different screen sizes and different resolutions. For this reason, the output buffer (amplifier circuit 90) of the data driver is optimized so that driving may be performed within a range of the capacitance (load capacitance) of the data line from several tens of pico farads (in which one pico is $10^{-12}$) to several hundreds of pico farads.

As described with reference to FIGS. 12A and 12B, the output switch SW10 is disposed between the output terminal of the output buffer (amplifier circuit 90) and the data line 962. In the period T1 immediately after the start of the one data period, the switch SW10 is turned off. At this point, the load capacitance of the amplifier circuit 90 in the period T1 becomes substantially zero.

No problem arises in the period T1 even if some variation occurs in the output signal of the amplifier circuit 90. However, the output of the amplifier circuit 90 must be stabilized before completion of the period T1. When the output signal of the amplifier circuit 90 is oscillated in the period T1, oscillation noise is sometimes amplified and transmitted to the data line 962 at an instant of switching from the period T1 to the period T2. For this reason, the amplifier circuit 90 must be operated stably throughout the periods T1 and T2.

Accordingly, the amplifier circuit 90 is optimized so as to be stably operated in a range of the load capacitance from zero to several hundreds of pico farads.

As is known, a phase margin can be used as a measure of determining whether the amplifier circuit operates stably. The larger the phase margin is, the more stability of the output of the amplifier is increased.

However, in order to ensure a sufficient phase margin in the range of the load capacitance from zero to several hundreds of pico farads, the capacitance value of the phase compensation capacitor C1 of the amplifier circuit 90 must be sufficiently increased.

An effect of restraining the capacitance value of the phase compensation capacitor C1 is limited even if the zero compensation resistor R1 is employed as in FIG. 12A (details of which will be described with reference to FIG. 10 that will be described later).

When the capacitance value of the phase compensation capacitor C1 is increased, a problem arises that the area of the amplifier circuit 90 is increased, thus leading to an increase in a cost of a data driver LSI.

When the capacitance value of the phase compensation capacitor C1 is increased, reduction of the band of the amplifier circuit 90 and reduction of a speed of the amplifier circuit 90 are brought about. Specifically, a slew rate (slew rate) of an output of the amplifier circuit 90 is reduced.

In order to avoid occurrence of this reduction of the slew rate, an idling current (a static consumption current) of the amplifier circuit 90 must be increased. For this reason, a problem also arises that power consumption of the amplifier circuit 90 is increased, thereby leading to an increase in power consumption of the data driver LSI.

Problems similar to those in FIG. 12A will arise when the AB-class output circuit in FIG. 13 is replaced by the amplifier circuit 90 in FIG. 12A, for use.

On the other hand, when the operational amplifier in FIG. 14 is replaced by the amplifier circuit 90 in FIG. 12A and is used, on-off control over the switches S1 and S2 can be performed, corresponding to turning ON and OFF of the output switch SW10. The capacitance values of the phase compensation capacitors can be thereby switched. However, there is a problem that when a voltage signal of a different level in accordance with image data is amplified and output for each output period, large noise is induced in an output signal of the operational amplifier in FIG. 14 when switching of the capacitance values is made, due to charging and discharging of the connected capacitors and potential variations at terminals through the connected capacitors. There is a problem that when state switching is made in a short time, in particular, the output signal cannot be stabilized within a predetermined period (such as the period T1 or T2 in FIG. 12B).

Further, an approach to switching the capacitance values of the phase compensation capacitors does not lead to reduction of the area of each of the phase compensation capacitor and does not lead to an effect of reducing the cost of a driver LSI.

Accordingly, an object of the present invention is to provide a data driver for a display device in which area saving is accomplished and cost reduction is achieved.

Other object of the present invention is to provide a data driver for a display device in which power consumption is reduced.

Still other object of the present invention is to provide a display device in which by using the data driver described b above, lower cost and lower power consumption are achieved.

The invention disclosed in this application is generally configured as follows.

According to one aspect of the present invention, there is provided a data driver including an amplifying circuit that receives a voltage signal corresponding to a data signal supplied to said data driver, performs amplification of said voltage signal and outputs a resulting signal to an output terminal of said data driver, said amplifying circuit comprising: a phase compensation capacitor and a zero compensation resistor; and a control circuit that controls to switch a resistance value of said zero compensation resistor to one of at least two mutually different resistance values responsive to a first control signal.

In the present invention, the phase compensation capacitor and the zero compensation resistor are connected in series between one output node of an input differential amplification stage of the amplifying circuit and one output node of a succeeding amplification stage of the amplifying circuit.

In the present invention, the data driver further includes: an output switch connected between an output terminal of said amplifying circuit and said output terminal of said data driver, said output switch being ON/OFF controlled by a second control signal supplied thereto. The control circuit switches the resistance value of said zero compensation resistor to a first resistance value or a second resistance value in association with ON and OFF of said output switch, the first resistance value and the second resistance value being different to each other.

In the present invention, said control circuit sets the resistance value of said zero compensation resistor to a smaller one of first and second resistance values that are different to each other when said output switch is OFF; and said control circuit switches the resistance value of said zero compensation resistor to a larger one of the first and second resistance values when said output switch is ON.

In the present invention, the control circuit includes:

a switch transistor connected between two voltage-dividing nodes inclusive of both ends of said zero compensation resistor, said switch transistor being ON/OFF controlled by the first control signal supplied to a control terminal thereof.

In the present invention, the zero compensation resistor may include at least two transistors set to be in an on state and cascode connected; and the control circuit may include: a switch transistor connected in parallel with one of the two transistors cascode connected, the first control signal being supplied to a control terminal of the switch transistor.

In the present invention, the zero compensation resistor may include first and second resistors connected in series; and the control circuit may include: a switch transistor connected in parallel with one of the first resistor and the second resistor, the first control signal being supplied to a control terminal of the switch transistor.

In the present invention, the amplifying circuit includes:

a differential pair that includes first and second input terminals and receives said voltage signal at the first input terminal;

a first current source connected to a first power supply, said first current source supplying a current to said differential pair;

a load circuit connected between an output pair of said differential pair and a second power supply; and an amplification stage that has an input terminal connected to at least one of connection nodes between the output pair of said differential pair and said load circuit and an output terminal connected to an output terminal of said amplifying circuit, a signal at said output terminal of said amplifying circuit being fed back to the second input terminal of said differential pair;

said zero compensation resistor and said phase compensation capacitor being connected in series between said output terminal of said amplifying circuit and said one connection node between said amplification stage and said load circuit.

In the present invention, the amplification stage includes:

a first output transistor connected between a second power supply and said output terminal of said amplifying circuit, one of said connection nodes between the output pair of said differential pair and said load circuit being connected to a control terminal of said first output transistor; and a second current source connected between said output terminal of said amplifying circuit and said first power supply.

In the present invention, the data driver includes:

a second current source connected between said first power supply and a first node;

a floating current source circuit connected between said first node and a second node;

a third current source connected between said second node and said second power supply;

a first output transistor connected between said second power supply and said output terminal of said amplifying circuit, a control terminal of said first output transistor being connected to said second node and to one of said connection nodes between the output pair of said differential pair and said load circuit; and a second output transistor connected between said first power supply and said output terminal of said amplifying circuit, a control terminal of said second output transistor being connected to said first node. The floating current source circuit includes two floating current sources connected in parallel between said first node and a second node.

In the present invention, the amplifying circuit includes:

a first differential pair that has first and second input terminals and receives a first input signal at the first input terminal;

a first current source that supplies a current to said first differential pair, said first current source being connected to a first power supply;

a first load circuit connected between an output pair of said first differential pair and a second power supply; and a first amplification stage that has an input terminal connected to at least one of connection nodes between the output pair of said first differential pair and said first load circuit and an output terminal connected to a first output terminal of said amplifying circuit;

a signal at said first output terminal of said amplifying circuit being fed back to the second input terminal of said first differential pair;

a first set of the zero compensation resistor and the phase compensation capacitor being connected in series between the output terminal of said amplifying circuit and one of said connection nodes between said first amplification stage and said first load circuit.

The amplifying circuit further includes:

a second differential pair that has first and second input terminals and receives a second input signal at the first input terminal;

a second current source that supplies a current to said second differential pair, said second current source being connected to said second power supply;

a second load circuit connected between an output pair of said second differential pair and said first power supply; and a second amplification stage that has an input terminal connected to at least one of connection nodes between the output pair of said second differential pair and said second load circuit, and has an output terminal connected to a second output terminal of said amplifying circuit;

a signal at said second output terminal of said amplifying circuit being fed back to the second input terminal of said second differential pair;

a second set of the zero compensation resistor and the phase compensation capacitor being connected in series between the output terminal of said amplifying circuit and one of said connection nodes between said second amplification stage and said second load circuit;

the control circuit switching the resistance value of the zero compensation resistor of said first set to a first resistance value or a second resistance value different from the first resistance value according to the first control signal; and the control circuit switching the resistance value of the zero compensation resistor of said second set to a third resistance value or a fourth resistance value different from the third resistance value according to a second control signal.

In the present invention, the data driver includes:

a first output switch connected between said first output terminal of said amplifying circuit and a first output terminal of said data driver;

a second output switch connected between said second output terminal of said amplifying circuit and a second output terminal of said data driver;

a third output switch connected between said first output terminal of said amplifying circuit and said second output terminal of said data driver; and a fourth output switch connected between said second output terminal of said amplifying circuit and said first output terminal of said data driver.

In the present invention, the data driver includes:

a third current source connected between said first power supply and a first node;

a first floating current source circuit connected between said first node and a second node;

a fourth current source connected between said second node and said second power supply;

a first output transistor connected between said second power supply and said first output terminal of said amplifying circuit, a control terminal of said first output transistor being connected to said second node and to one of said connection nodes between the output pair of said first differential pair and said first load circuit;

a second output transistor connected between said first power supply and said first output terminal of said amplifying circuit, a control terminal of said second output transistor being connected to said first node;

a fifth current source connected between said second power supply and a third node;

a second floating current source circuit connected between said third node and a fourth node;

a sixth current source connected between said fourth node and said first power supply;

a third output transistor connected between said second power supply and said second output terminal of said amplifying circuit, a control terminal of said third output transistor being connected to said third node; and a fourth output transistor connected between said first power supply and said second output terminal of said amplifying circuit, a control terminal of said fourth output transistor being connected to said fourth node and to one of said connection nodes between the output pair of said second differential pair and said second load circuit. The first floating current source circuit includes two floating current sources of two different conductivity types connected in parallel between the first node and the second node. The second floating current source circuit includes two floating current sources of two different conductivities connected in parallel between the third node and the fourth node.

In the present invention, the data driver includes:

a plurality of the amplifying circuits corresponding to a plurality of output terminals of the data driver, respectively; the plurality of the amplifying circuits being grouped into at least first and second groups; and switching of the resistance value of the zero compensation resistor being made for each of the groups, in the plurality of the amplifying circuits.

A differential amplifier circuit according to the present invention includes a zero compensation resistor between one output node of an initial differential amplification stage and a predetermined output node of a succeeding amplification stage, the zero compensation resistor being connected in series with a phase compensation capacitor, the differential amplifier including: a control circuit that variably controls a resistance value of the zero compensation resistor responsive to a control signal.

In the present invention, the control circuit switches the resistance value of the zero compensation resistor to a larger resistance value or a smaller resistance value according to a magnitude of a load capacitance connected to an output terminal of the differential amplifier circuit, based on the control signal.

In a display device according to the present invention, the data driver of the present invention is employed as a data driver that drives the data line.

The meritorious effects of the present invention are summarized as follows.

According to the present invention, using an amplifying circuit including a phase compensation capacitor and a zero compensation resistor as an output buffer of the data driver, the resistance value of the zero compensation resistor is switched to an optimum resistance value according to a change in a capacitance value of the load capacitance. A capacitance value of the phase compensation capacitor can be thereby reduced, with a phase margin maintained.

Further, according to the present invention, switching of the resistance value of the zero compensation resistor is made between terminals with a same potential. Thus, noise is scarcely induced in an output signal of the amplifying circuit at a time of the switching.

Further, according to the present invention, by reducing the capacitance value of the phase compensation capacitor, the area of the amplifying circuit can be reduced. Area saving and lower cost of the data driver for the display device can be achieved.

Still further, according to the present invention, an idling current (a static consumption current) of the amplifying circuit can also be reduced with maintaining a predetermined slew rate due to reduction of the capacitance value of the phase compensation capacitor. With this arrangement, lower power of the data driver for the display device can also be achieved.

Then, according to the present invention, a display device capable of achieving area saving (lower cost) and lower power can be provided.

Still other features and advantages of the present invention will become readily apparent to those skilled in this art from the following detailed description in conjunction with the accompanying drawings wherein examples of the invention are shown and described, simply by way of illustration of the mode contemplated of carrying out this invention. As will be realized, the invention is capable of other and different examples, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIG. 2 is a table explaining switch control in the data driver in the example of the present invention;

PREFERRED MODES OF THE INVENTION

Examples of the present invention will be given below with reference to appended drawings.

Figure 1:
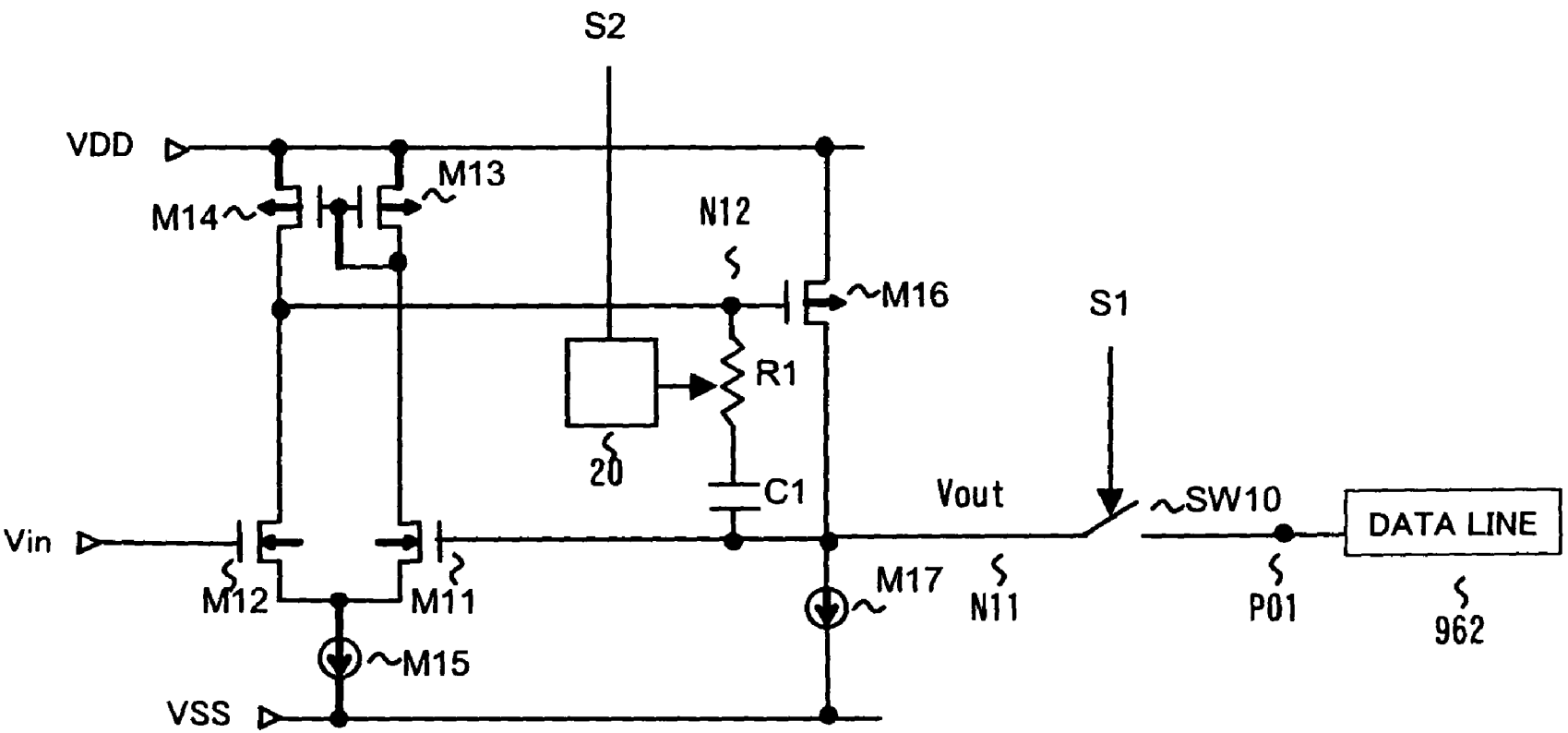
FIG. 1 is a diagram showing a configuration of a data driver of the present invention in an example mode.

FIG. 1 is a diagram showing a configuration of a first example of the present invention. FIG. 1 is the diagram showing a configuration of an output buffer of a data driver of a liquid crystal display device.

In this example, there is provided a control circuit 20 that controls a resistance value of a zero compensation resistor R1 in an amplifier circuit (refer to FIG. 12A), which includes a phase compensation capacitor C1 and the zero compensation resistor R1 connected in series with the phase compensation capacitor C1.

The amplifier circuit in this example includes a current source M15 which has a first terminal connected to a low voltage power supply VSS, a differential pair formed of N-channel transistors M11 and M12 (represented by the differential pair (M11, M12)) which have coupled sources connected to a second terminal of the current source M15, a current mirror which is composed of P-channel transistors M13 and M14 (represented by the current mirror (M13, M14)) connected between an output pair of the differential pair (M11, M12) and a high voltage power supply VDD, a P-channel transistor M16 which has a gate connected to an output terminal node N12 of the current mirror (M13, M14), a source connected to the high voltage power supply VDD, and a drain connected to an amplifier output terminal N11, and a current source M17 which is connected between the low voltage power supply VSS and the amplifier output terminal N11. An inverting input terminal (a gate of the transistor M11) of the differential pair (M11, M12) in the amplifier circuit is connected to the amplifier output terminal N11. A voltage Vin selected by a decoder, corresponding to an input video data (not shown) supplied to a data driver is applied to a non-inverting input terminal (a gate of the transistor M12) of the differential pair (M11, M12).

The phase compensation capacitor C1 and the zero compensation resistor R1 are connected in series between the gate of the transistor M16 (node N12) and the drain of the transistor M16 (amplifier output terminal N11).

An output switch SW10 that is ON/OFF controlled by a control signal S1 is provided between the output terminal N11 of the amplifier circuit and a data line 962.

The control circuit 20 switches a resistance value of the zero compensation resistor R1 to a first resistance value or a second resistance value, according to a value of a control signal S2. The first resistance value and the second resistance value are different to each other. One of the first and second resistance values may be set to zero ohm (with the resistance value between terminals of the resistor being 0 ohm, with no such resistance not provided, or with both ends of the resistor short-circuited).

The control signal S2 is set to the control signal in conjunction with the control signal S1 that performs on/off control over the output switch SW1. Resistance value switching of the zero compensation resistor is performed, responsive to the ON/OFF control of the output switch SW10.

FIG. 2 shows ON/OFF control of the output switch SW10 by the control signal S1 and control over the control circuit 20 by the control signal S2 in one data period in which a signal voltage Vin corresponding to one data of a gray scale signal is amplified and output to the data line 962. The one data period includes a period T1 and a period T2.

In the period T1, the output switch SW10 is set to an OFF state, and the output terminal N11 of the amplifier circuit and a driver output terminal P01 are disconnected. In this case, a load capacitance of the amplifier circuit becomes substantially zero. During the period T1, the control circuit 20 sets the resistance value of the zero compensation resistor R1 to a comparatively small resistance value (first resistance value).

The period T1 is the period for preventing transition noise induced in the decoder at a time of data switching from being transmitted to the data line 962. The period T1, which is a comparatively short time, is set immediately after switching of each data period.

In the period T2 after the period T1, the switch SW10 is set to an ON state, the output terminal N1 of the amplifier circuit and the driver output terminal P01 are connected, and the signal voltage Vin is amplified and output to the data line 962. The load capacitance of the amplifier circuit in this case becomes a load capacitance of the data line 962.

In the period T2, the control circuit 20 switches the resistance value of the zero compensation resistor R1 to a resistance value (second resistance value) higher than that in the period T1.

With this arrangement, the amplifier circuit can be maintained to have a high phase margin and can be stably operated throughout the periods T1 and T2.

Switching of the output switch SW10 and switching of the resistance value of the zero compensation resistor R1 may be controlled by synchronization control, or at a timing shifted by a predetermined time.

Next, control over the load capacitance of the amplifier circuit and the resistance value of the zero compensation resistor R1 will be described below.

Figure 10:
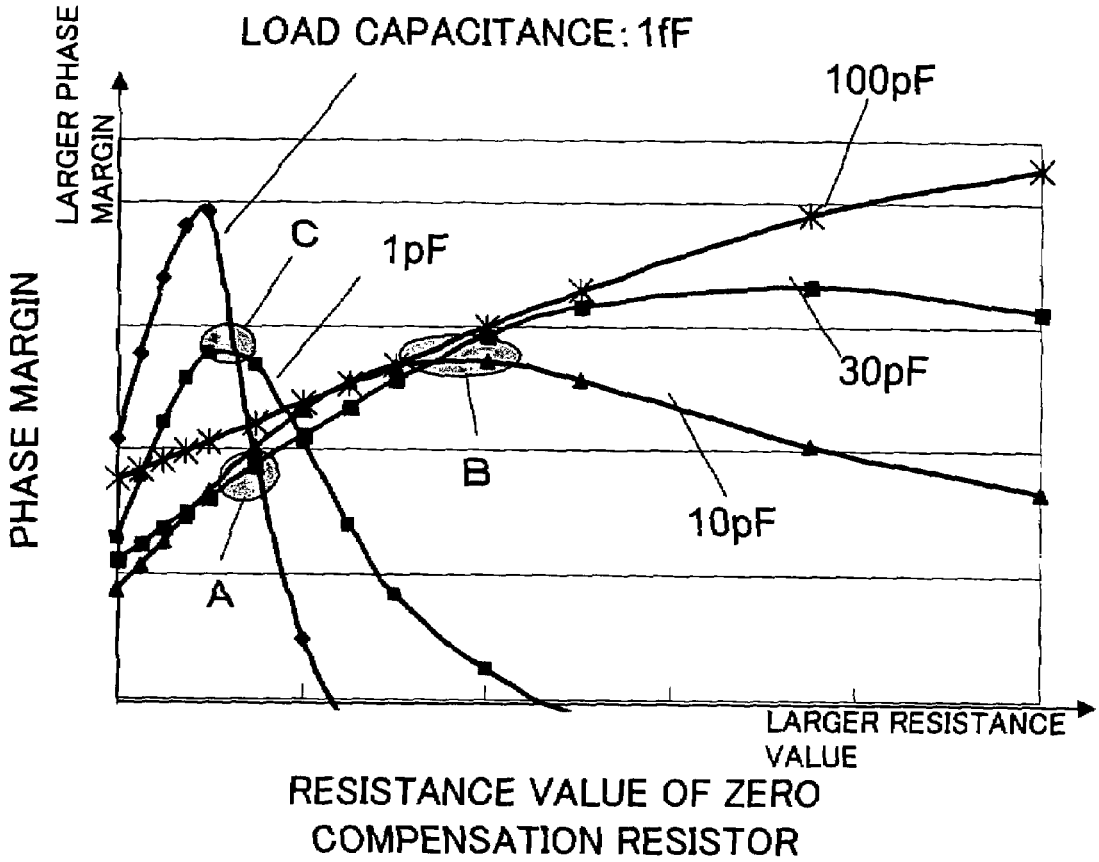
FIG. 10 is a graph for explaining a relationship between a resistance value of a zero compensation resistor and a phase margin in the present invention.
Figure 12A:
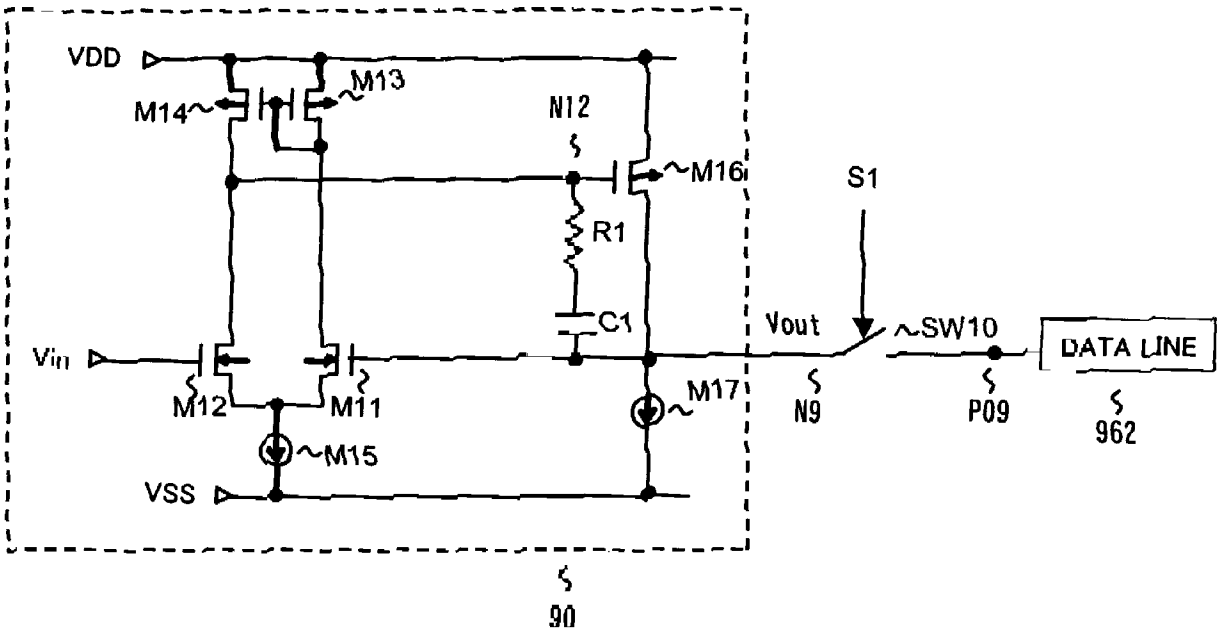
FIG. 12A RELATED ART
FIG. 12A is a diagram showing a connection configuration among a data driver, an output buffer, and a data line.

FIG. 10 is a graph showing the resistance value of the zero compensation resistor R1 of the amplifier circuit 90 in FIG. 12A and a phase margin. FIG. 10 shows a characteristic curve for each capacitance value of the load capacitance. The phase compensation capacitor C1 has a constant capacitance.

According to a result of analysis by the inventor of the present invention, in each characteristic curve in FIG. 10, the phase margin increases with an increase in the resistance value of the zero compensation resistor. When the resistance value of the zero compensation resistor exceeds a predetermined resistance value, the phase margin tends to decrease.

Further, in each characteristic curve in FIG. 10, the resistance value of the zero compensation resistor at which the phase margin becomes maximum tends to be shifted to a high resistance side as the load capacitance increases.

With respect to a relationship between the phase compensation capacitor C1 and each characteristic curve, when the capacitance value of the phase compensation capacitor C1 increases, each characteristic curve tends to be shifted to a side of a high phase margin, with a shape of each characteristic curve maintained.

A case where an optimum value of the zero compensation resistor R1 of the amplifier circuit 90 in FIG. 12A is set based on results of FIG. 10 will be explained.

Figure 12B:
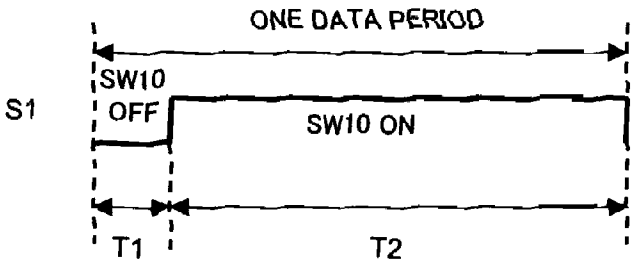
FIG. 12B RELATED ART
FIG. 12B is a diagram showing switch control.

During the periods T1 and T2 in FIG. 12B, the resistance value of the zero compensation resistor R1 is constant. Accordingly, in order to secure the phase margin of a certain level or higher for the load capacitance of zero to several hundreds of pico farads (pF), the resistance value of the zero compensation resistor R1 must be set to a resistance value of the zero compensation resistor in the vicinity of a region A of FIG. 10. The reason for performing this setting is as follows.

If the resistance value of the zero compensation resistor is larger than that in the region A, the phase margin when the load capacitance is 1 fF or less is reduced. If the resistance value of the zero compensation resistor is smaller than that in the region A, the phase margin when the load capacitance is 10 pF to 30 pF is reduced. Then, when the phase margin in the region A is not sufficient, the capacitance value of the phase compensation capacitor C1 must be increased to raise the phase margin.

On the other hand, when the optimum value of the zero compensation resistor R1 in the amplifier circuit in FIG. 1 is set, based on FIG. 10, the optimum value can be set to the different resistance values of the zero compensation resistor for the periods T1 and T2 in FIG. 2, respectively.

During the period T1 in FIG. 2, the load capacitance is substantially zero. Thus, the first resistance value can be set to the resistance value of the zero compensation resistor in the vicinity of a region C in FIG. 10. In the region C, a high phase margin can be obtained for the load capacitance of 1 pF or lower.

During the period T2 in FIG. 2, the load capacitance ranges from several tens of pico farads to several hundreds of pico farads. Thus, the second resistance value can be set to the resistance value of the zero compensation resistor in the vicinity of a region B in FIG. 10. In the region B, a high phase margin can be obtained for the load capacitance of 10 pF or higher.

Each of the region B and the region C in FIG. 10 has the phase margin higher than the region A. Accordingly, the amplifier circuit in this example mode, shown in FIG. 1 can obtain the phase margin higher than the amplifier circuit in FIG. 12A, for the same phase compensation capacitor C1.

When the amplifier circuit in FIG. 1 achieves a sufficiently high phase margin and has an operating margin, the capacitance value of the phase compensation capacitor C1 in the amplifier circuit in FIG. 1 can be reduced, thereby accomplishing area saving. When the capacitance value of the phase compensation capacitor C1 is reduced, a slew rate can be maintained even if an idling current of the amplifier circuit is reduced. Accordingly, lower power consumption can be also achieved.

In the example described above, a description was given to a case where the second resistance value of the zero compensation resistor R1 was set to ensure the phase margin of a preset certain level or higher, for the load capacitance of several tens of pico farads to several hundreds of pico farads, in common. The zero compensation resistor R1 may includes further a third resistance value in accordance with a range of the load capacitance.

With respect to the area of the zero compensation resistor, the zero compensation resistor R1 can be formed of an arbitrary resistance element. Thus, when a high resistance element is employed for the zero compensation resistor R1, the zero compensation resistor R1 can be implemented with the smaller area than the phase compensation capacitor C1. Also when the zero compensation resistor is composed of a transistor, the zero compensation resistor can be implemented with the smaller area than the phase compensation capacitor C1. Meanwhile, when the zero compensation resistor is composed of the transistor, the resistance value of the zero compensation resistor varies a little according to an output voltage of the amplifier circuit in FIG. 1. Thus, it is necessary to set the size of the transistor to the one in consideration of the variation.

In terms of noise induced due to switching of the resistance value of the zero compensation resistor R1, the zero compensation resistor R1 and the phase compensation capacitor C1 in the amplifier circuit in FIG. 1 are connected in series.

For this reason, in a stable state of an output of the amplifier circuit, potentials at both ends of the zero compensation resistor R1 become the same. Thus, even if the resistance value is switched between the terminals with the same potential, noise is scarcely induced in an output signal of the amplifier circuit at a time of switching.

As described above, the output buffer of the data driver in FIG. 1 switches the resistance value of the zero compensation resistor R1 to an optimum resistance value according to each of the periods T1 and T2, thereby achieving a high phase margin. A stable operation of the amplifier circuit can be thereby implemented throughout the periods T1 and T2. For this reason, the capacitance value of the phase compensation capacitor C1 can be reduced, and the area of the amplifier circuit can also be reduced. Further, lower power consumption of the amplifier circuit is also possible. With this arrangement, area saving, lower cost, and lower power consumption of the data driver of the display device can be achieved.

Figure 3:
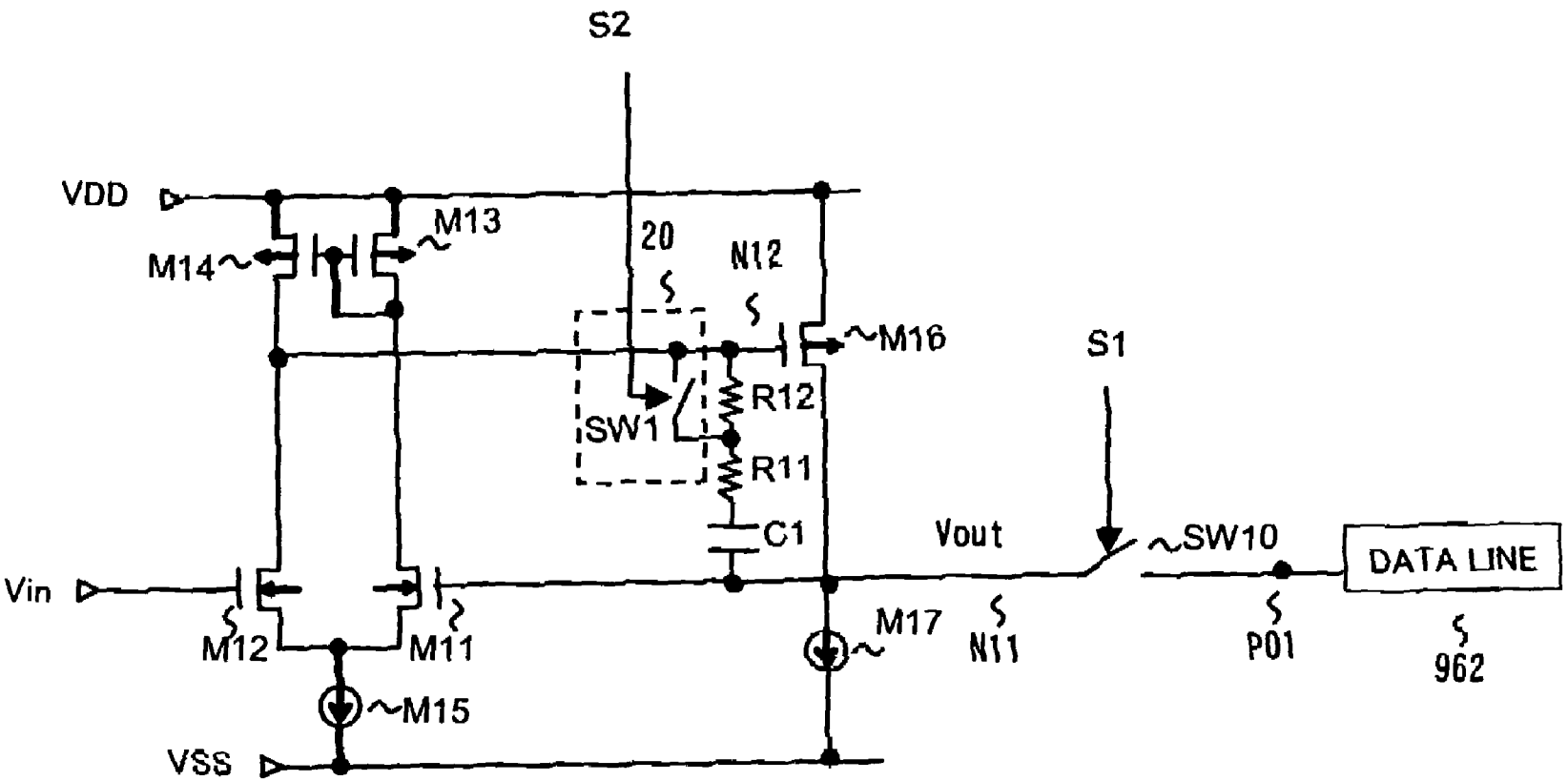
FIG. 3 is a diagram showing a configuration of a data driver in an example of the present invention.

FIG. 3 is a diagram showing a configuration of the output buffer of the data driver in FIG. 1 in an example. FIG. 3 shows specific configurations of the zero compensation resistor R1 and the control circuit 20 in FIG. 1. Other components are the same as those in FIG. 1.

Referring to FIG. 3, the zero compensation resistor R1 in FIG. 1 is composed of two resistors R11 and R12 connected in series. The control circuit 20 includes a switch SW1 connected between both ends of the resistor R12. The switch SW1 is On/OFF controlled by the control signal S2.

Figure 4:
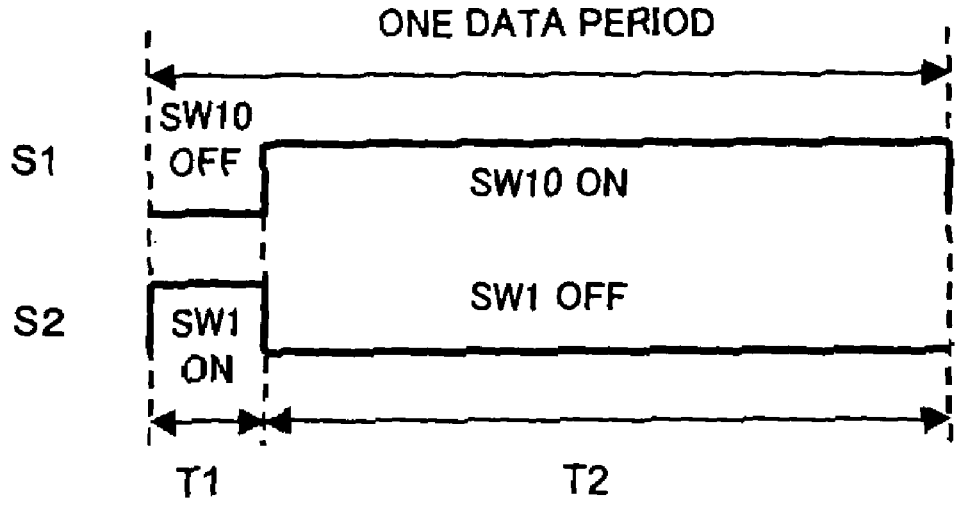
FIG. 4 is a timing chart explaining switch control in the data driver in the example of the present invention.

FIG. 4 is a timing chart showing ON/OFF control of the switch SW10 and the switch SW1 by the control signals S1 and S2, respectively, in one data period of the output buffer in FIG. 3. The one data period is composed of the periods T1 and T2.

During the period T1, the control signals S1 and S2 are controlled to be low and high, respectively. The output witch SW10 and the switch SW1 are set to OFF and ON, respectively. In this case, the switch SW1 short-circuits both ends of the resistor R12, so that the zero compensation resistor is composed of the resistor R11 alone.

During the period T2, the control signals S1 and S2 are controlled to be high and low, respectively. The output switch SW10 and the switch SW1 are then set to ON and OFF, respectively. In this case, the zero compensation resistor is composed of a combined resistor of the resistors R11 and R12, and is controlled to be switched to have a resistance value higher than that in the period T1. The resistor R12 may have a positive resistance value, and the resistor R11 may have a resistance value including zero ohm.

As described above, the output buffer of the data driver in FIG. 3 switches the resistance value of the zero compensation resistor to the optimum resistance value according to each of the period T1 and the period T2. A higher phase margin can be thereby achieved, and the stable operation of the amplifier circuit can be thereby implemented throughout the periods T1 and T2. For this reason, the capacitance value of the phase compensation capacitor C1 can be reduced, and the area saving of the amplifier circuit can be achieved. Further, lower power consumption of the amplifier circuit can also be achieved. Thus, with this arrangement, area saving, lower cost, and lower power consumption of the data driver of the display device can be achieved.

Figure 5:
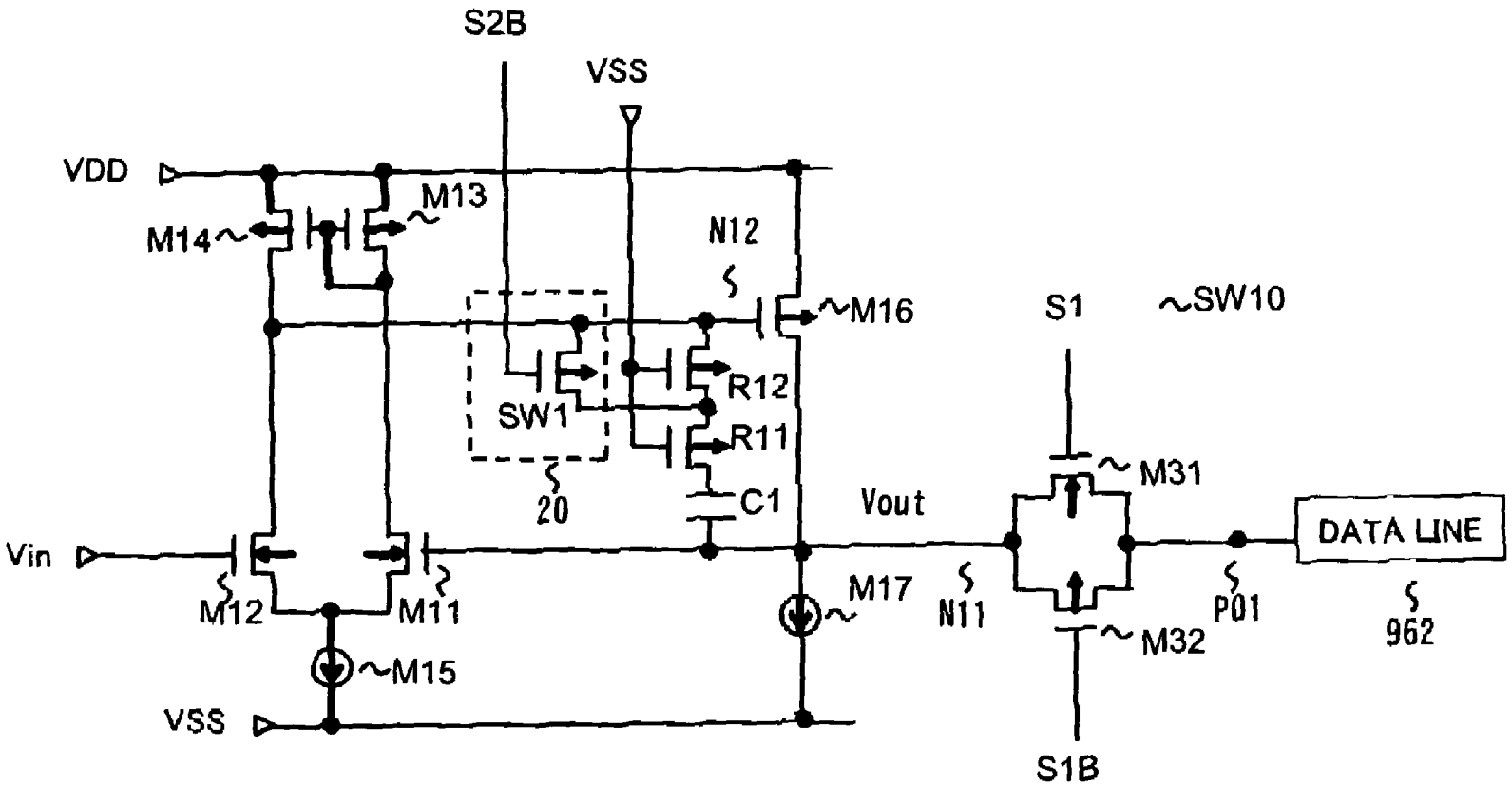
FIG. 5 is a diagram showing a configuration of a data driver in a second example of the present invention.

FIG. 5 is a diagram showing a configuration of a data driver in a second example of the present invention. In this example, modification is done to the output buffer of the data driver shown in FIG. 3. Referring to FIG. 5, each of the zero compensation resistors R11 and R12 and the switches SW10 and SW1 in FIG. 3 in this example is composed of a transistor. Components other than these are the same as those shown in FIG. 3.

Referring to FIG. 5, the switch SW10 is composed of a CMOS switch (a CMOS transfer gate), and the control signal S1 and a complementary signal S1B of the control signal S1 are applied to gates of an NMOS transistor M31 and a PMOS transistor M32 of the CMOS switch, respectively.

The zero compensation resistors R11 and R12 are composed of PMOS transistors which have gates applied with a voltage of the low-voltage power supply VSS. on-resistances of the respective PMOS transistors are used as the zero compensation resistor. A bias voltage other than the low-voltage power supply VSS may be applied to the gate terminal.

The zero compensation resistors R11 and R12 may be formed of transistors of a CMOS configuration. In the case of the CMOS configuration, the high-potential side supply voltage VDD is applied to a gate terminal of an NMOS transistor.

Meanwhile, a value of the resistance of the transistor (on-resistance of the MOS transistor) changes according to an output voltage of the amplifier circuit. For this reason, when the transistor resistance is used, a device size and a voltage applied to each control terminal are set so that a change in the value of the transistor resistance is within a range in the vicinity of the resistance value of the zero compensation resistor that has been set.

Figure 6:
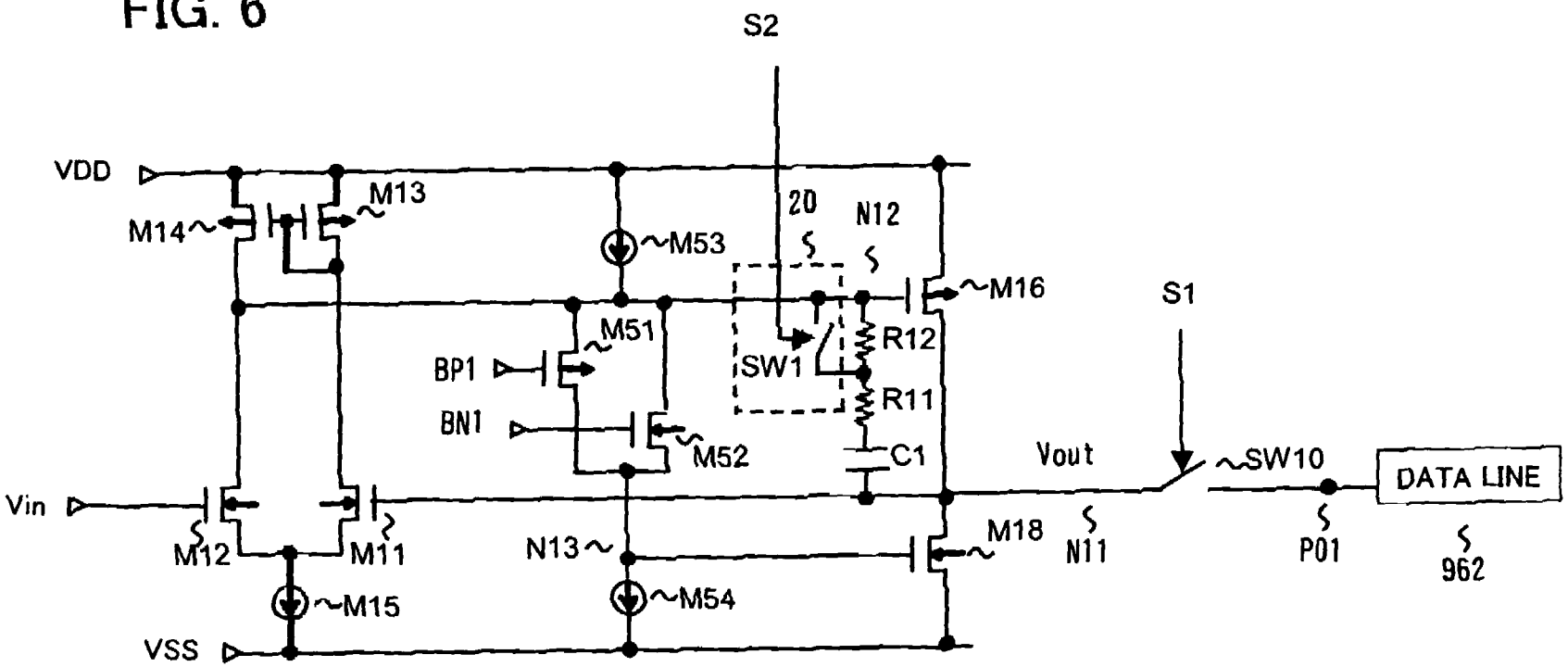
FIG. 6 is a diagram showing a configuration of a data driver in a third example of the present invention.

FIG. 6 is a diagram showing a configuration of the output buffer of the data driver in FIG. 1 in a third example. An amplifier circuit in FIG. 6 is a configuration to which an AB-class output circuit in FIG. 13 has been applied. The zero compensation resistors and the control circuit 20 are the same as those in FIG. 3.

Referring to FIG. 6, the amplifier circuit in FIG. 6 includes a differential input stage, an intermediate stage, and an output stage. The differential input stage includes an N-channel differential pair (M11, M12), a current source M15 with one end thereof connected to a low voltage power supply VSS, and a P-channel current mirror (M13, M14) connected between an output pair of the N-channel differential pair (M11, M12) and a high voltage power supply VDD. The current source M15 supplies a current to the N-channel differential pair (M11, M12). A signal voltage Vin is supplied to a non-inverting input terminal (a gate of the transistor M12) of an input pair of the N-channel differential pair (M11, M12), and an inverting input terminal of the input pair of the N-channel differential pair (M11, M12) is connected to an amplifier output terminal N11.

An amplification stage includes an amplifying transistor M16 for a charging operation and an amplifying transistor M18 for a discharging operation. An output terminal (a connection node between the transistors M12 and M14) of the P-channel current mirror (M13, M14) is connected to a gate of the amplifying transistor M16, and the amplifying transistor M16 is connected between the high voltage power supply VDD and the output terminal N11 of the amplifier circuit. The amplifying transistor M18 is connected between the output terminal N11 of the amplifier circuit and the low voltage power supply VSS.

The intermediate stage includes floating current sources M51 and M52 and current sources M53 and M54. The floating current source M51 is composed of a P-channel transistor M51 that has a gate supplied with a bias voltage BP1, a source connected to a gate N12 of the amplifying transistor M16, and a drain connected to a gate terminal N13 of the amplifying transistor M18. The floating current source M52 is composed of an N-channel transistor M52 that has a gate supplied with a bias voltage BN1, a drain connected to a gate terminal N12 of the amplifying transistor M16, and a source connected to the gate terminal N13 of the amplifying transistor M18.

The current source M53 is connected between the high voltage power supply VDD and the gate terminal N12 of the amplifying transistor M16. The current source M54 is connected between the low voltage power supply VSS and the gate terminal N13 of the amplifying transistor M18.

A sum of currents of the floating current sources M51 and M52 is set to be substantially equal to a current of each of the current sources M53 and M54.

Figure 13:
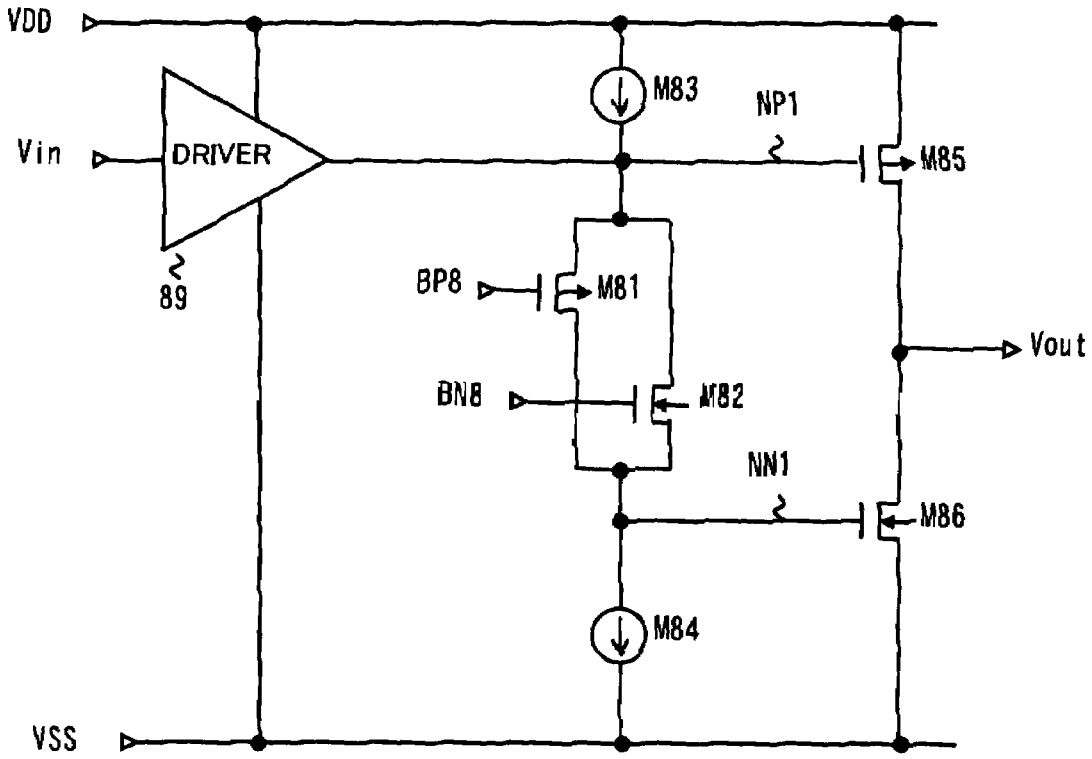
FIG. 13 RELATED ART
FIG. 13 is a diagram showing a configuration of an output circuit disclosed in Patent Document 2.
Figure 14:
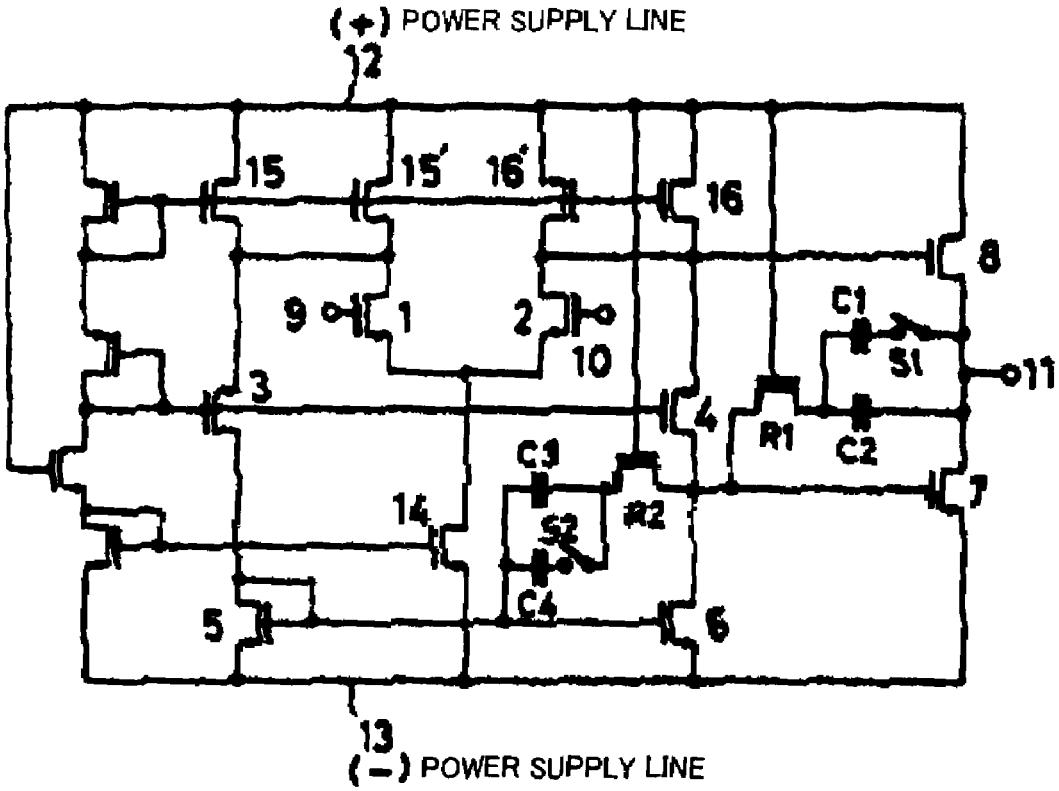
FIG. 14 RELATED ART
FIG. 14 is a diagram showing a configuration of an operational amplifier circuit disclosed in Patent Document 2.

The amplifier circuit shown in FIG. 6 is the one to which the AB-class output circuit in FIG. 13 has been applied, and a driver 89 in FIG. 13 is replaced by the differential input stage. Accordingly, the amplifier circuit shown in FIG. 6 also has a characteristic of the AB-class output circuit in FIG. 13. That is, a value of the current that flows through each of the floating current sources M81 and M82 and the current sources M83 and M84 in the intermediate stage can be sufficiently reduced. Thus, with a comparatively small idling current, a high-speed charging operation and a high-speed discharging operation can be implemented.

In the circuit shown in FIG. 6, the zero compensation resistors R11 and R12 and the phase compensation capacitor C1 are connected in series between the gate terminal N12 of the amplifying transistor M16 and the output terminal N11 of the amplifier circuit, as in FIG. 3. Further, as the control circuit 20, a switch SW1 that short-circuits both ends of the resistor 12 is connected.

Each of the zero compensation-resistances R11 and R12 and the switch SW1 may be formed of a transistor, as in FIG. 5.

A relationship between a resistance value of the zero compensation resistor of the amplifier circuit in FIG. 6 and a phase margin of the amplifier circuit has substantially the same characteristic as that shown in FIG. 10. A relationship between an absolute value of the resistance value of the zero compensation resistor and an absolute value of the phase margin in each characteristic curve in FIG. 10 differs, depending on an amplifier circuit. However, tendencies of each characteristic curve described in FIG. 10 are the same.

Accordingly, the output buffer of the data driver shown in FIG. 6 also switches the resistance value of the zero compensation resistor to an optimum resistance value according to each of the periods T1 and T2, thereby achieving a high phase margin. A high-speed stable operation of the amplifier circuit can be therefore implemented throughout the periods T1 and T2. For this reason, a capacitance value of the phase compensation capacitor C1 can be reduced, and the area of the amplifier circuit can be reduced. Further, lower power consumption of the amplifier circuit is also possible. With this arrangement, area saving, cost reduction, and lower power consumption of the data driver for a display device can be achieved.

Figure 7:
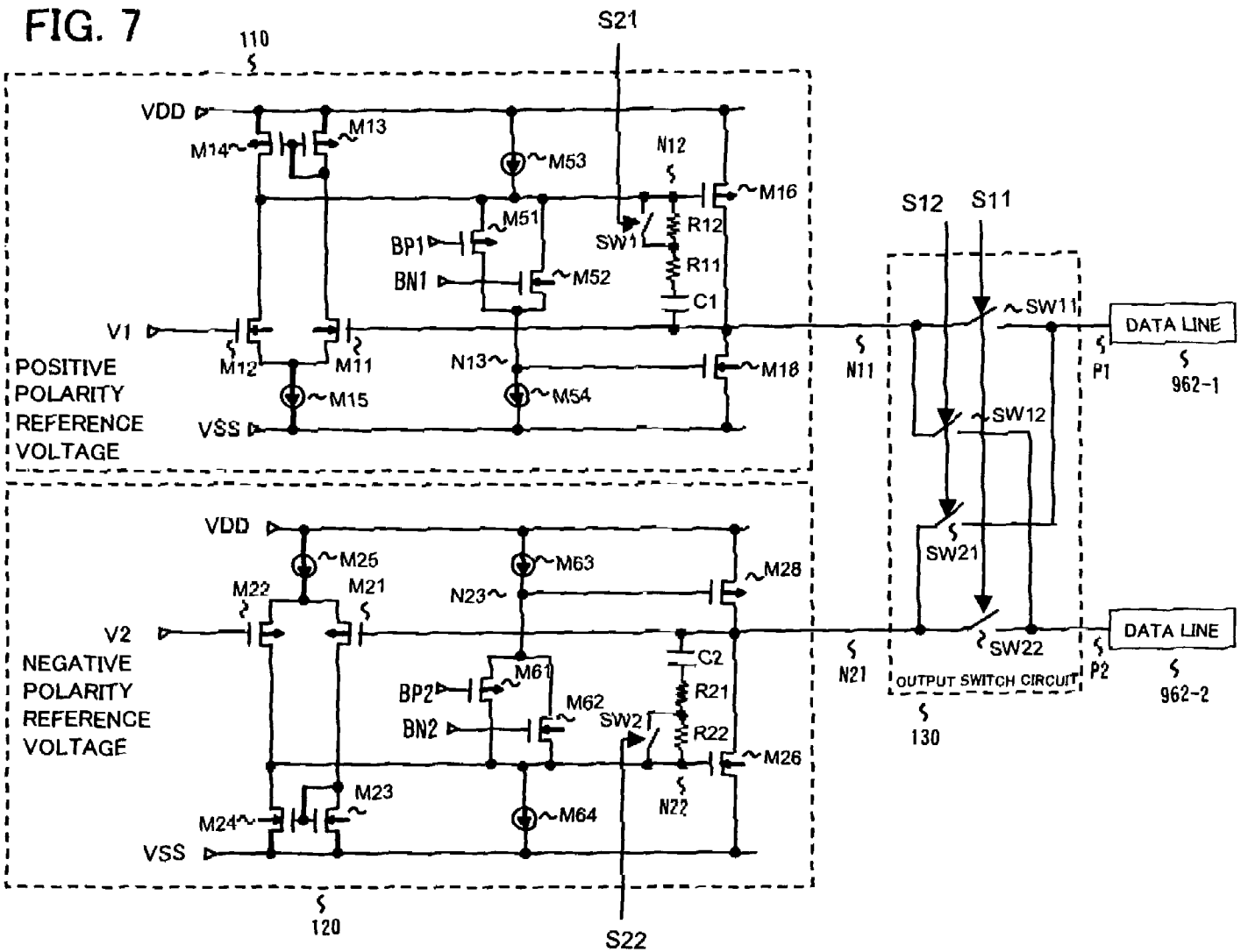
FIG. 7 is a diagram showing a data driver in a fourth example of the present invention.

FIG. 7 is a diagram showing a configuration of the output buffer of the data driver in FIG. 1 in a fourth example. FIG. 7 shows the configuration of the output buffer for two outputs in the data driver that performs dot inversion driving and that is suitable for driving a liquid crystal.

Recently, as a driving method of a large-screen display device such as a liquid crystal TV, a dot inversion driving scheme capable of providing higher image quality is adopted. The dot inversion driving scheme is a driving scheme in which an opposing substrate electrode voltage VCOM is fixed in a display unit (display panel) 960 in FIG. 11 and polarities of voltages held in adjacent pixels become opposite to each other. For this reason, polarities of voltages output to adjacent data lines (962-1, 962-2) in a same data period become positive and negative with respect to the opposing substrate electrode voltage VCOM. Further, a polarity of a voltage output to one data line is also inverted for every predetermined data periods.

Referring to FIG. 7, the output buffer in this example includes a positive polarity amplifier 110, a negative polarity amplifier 120, and an output switch circuit 130. The positive polarity amplifier 110 performs amplification and outputs a positive gray scale voltage Vout1 to an amplifier output terminal N11, based on a positive polarity reference voltage V1. The negative polarity amplifier 120 performs amplification and outputs a negative gray scale voltage Vout2 to an amplifier output terminal N21, based on a negative polarity reference voltage V2. The opposing substrate electrode voltage VCOM is set to be a voltage close to an intermediate voltage between a high voltage power supply VDD and a low voltage power supply VSS.

The positive polarity amplifier 110 has the same configuration as that of the amplifier circuit in FIG. 6, but the input voltage Vin is designated by the positive polarity reference voltage V1, and a control signal that controls a switch SW11 is designated by S21. Thus, a description of the positive polarity amplifier 110 will be omitted.

The negative polarity amplifier 120 has a configuration of a polarity opposite to that of the positive polarity amplifier 110. The negative polarity amplifier will be described below.

The negative polarity amplifier 120 includes a differential input stage, an intermediate stage, and an output stage. The differential input stage is composed of a P-channel differential pair (M21, M22), a current source M25 with one end thereof connected to the high voltage power supply VDD, and an N-channel current mirror (M23, M24) connected between an output pair of the P-channel differential pair (M21, M22) and the low voltage power supply VSS. The current source M25 supplies a current to the P-channel differential pair (M21, M22). A negative polarity reference voltage V2 is supplied to a non-inverting input terminal (a gate of the transistor M22) of an input pair of the P-channel differential pair (M21, M22), and an inverting input terminal (a gate of the transistor M21) of the input pair of the P-channel differential pair (M21, M22) is connected to an amplifier output terminal N21.

An amplification stage includes an amplifying transistor M26 for a discharging operation and an amplifying transistor M28 for a charging operation. An output terminal (a connection node between the transistors M22 and M24) of the N-channel current mirror (M23, M24) is connected to a gate of the amplifying transistor M26, and the amplifying transistor M26 is connected between the low voltage power supply VSS and the amplifier output terminal N21. The amplifying transistor M28 is connected between the amplifier output terminal N21 and the high voltage power supply VDD.

The intermediate stage includes floating current sources M61 and M62 and current sources M63 and M64. The floating current source M61 is composed of a P-channel transistor M61 that has a gate supplied with a bias voltage BP2, a drain connected to a gate terminal N22 of the amplifying transistor M26, and a source connected to a gate terminal N23 of the amplifying transistor M28. The floating current source M62 is composed of an N-channel transistor M62 that has a gate supplied with a bias voltage BN2, a source connected to the gate terminal N22 of the amplifying transistor M26, and a drain connected to the gate terminal N23 of the amplifying transistor M28.

The current source M63 is connected between the high voltage power supply VDD and the gate terminal N23 of the amplifying transistor M28. The current source M64 is connected between the low voltage power supply VSS and the gate terminal N22 of the amplifying transistor M26.

A sum of currents of the floating current sources M61 and M62 is set to be substantially equal to a current of each of the current sources M63 and M64.

The negative polarity amplifier 120 includes zero compensation resistors R21 and R22 and a phase compensation capacitor C2 connected in series between the gate terminal N22 of the amplifying transistor M26 and the amplifier output terminal N21. Further, a switch SW2 that short-circuits both ends of the resistor R22 responsive to a control signal S22 is connected.

The output switch circuit 130 includes switches SW11 and SW12 and switches SW21 and SW22. The switch SW11 is connected between the amplifier output terminal N11 and a driver output terminal P1, and the switch SW12 is connected between the amplifier output terminal N11 and a driver output terminal P2. The switch SW21 is connected between the amplifier output terminal N21 and the driver output terminal P1, and the switch SW22 is connected between the amplifier output terminal N21 and the driver output terminal P2. The switches SW11 and SW22 are ON/OFF controlled by a control signal S11, and the switches SW12 and SW21 are ON/OFF controlled by a control signal S12. Mutually adjacent data lines 962-1 and 962-2 are connected to the output terminals of said data driver P1 and P2, respectively.

Figure 8:
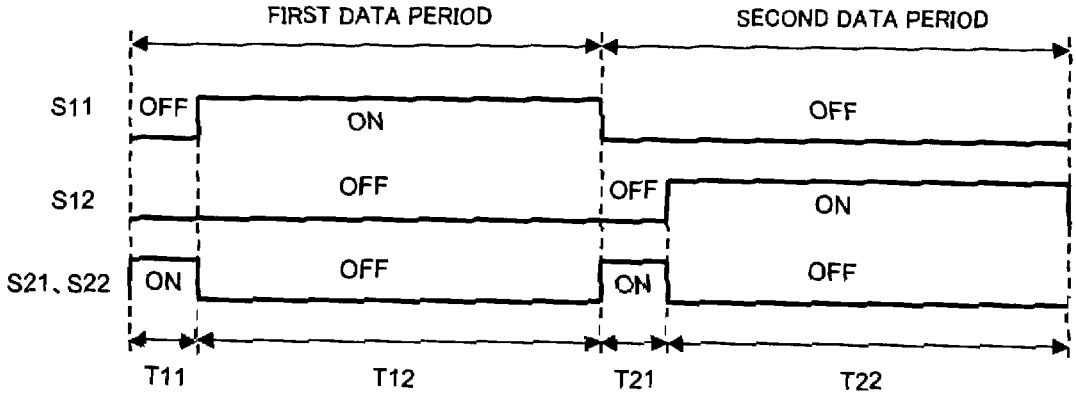
FIG. 8 is a timing chart explaining switch control in the data driver in the fourth example of the present invention.

FIG. 8 is a timing chart showing control over the respective switches using the control signals S11, S12, S21, and S22, in a first data period and a second data period of the output buffer in FIG. 7. Each data period is composed of at least two periods.

The first data period is divided into a period T11 and a period T12.

During the period T11 the control signals S11 and S12 are both controlled to be at a low level, and the control signals S21 and S22 are both controlled to be at a high level. Then, all of the switches SW11, SW12, SW21, and SW22 are OFF, and both of the switches SW1 and SW2 are ON.

In this case, the switch SW1 short-circuits both ends of the resistance R12 of the positive polarity amplifier 110. The zero compensation resistor is thereby set to the resistor R11 alone. The switch SW2 short-circuits both ends of the resistor R22 of the negative polarity amplifier 120. The zero compensation resistor is thereby set to the resistor R21 alone.

During the period T12, the control signals S11 and S12 are controlled to be at a high level and a low level, respectively. During the period T12, the switches SW11 and SW22 are ON, and the switches SW12 and SW 21 are OFF. The control signals S21 and S22 are both controlled to be at a low level, and the switches SW1 and SW2 are both OFF.

In this case, the zero compensation resistor of the positive polarity amplifier 110 is set to a combined resistor of the resistors R11 and R12. The zero compensation resistor of the negative polarity amplifier 120 is set to a combined resistor of the resistors R21 and R22. Each of the combined resistors is controlled to have a resistance higher than that in the period T11. A positive gray scale signal and a negative gray scale signal are supplied to the data lines 962-1 and 962-2, respectively.

The second data period is divided into a period T21 and a period T22.

The period T21 is controlled in the same manner as the period T11.

During the period T22, the control signals S11 and S12 are controlled to be at a low level and at a high level, respectively. Then, the switches SW11 and SW22 are OFF, and the switches SW12 and SW21 are ON. The control signals S21 and S22 are both controlled to be at a low level, and the switches SW1 and SW2 are both OFF.

In this case, each of the zero compensation resistors of the positive polarity amplifier 110 and the negative polarity amplifier 120 is controlled to have a resistance higher than that in the period T21. A negative gray scale signal and a positive gray scale signal are supplied to the data lines 962-1 and 962-2, respectively.

Like the amplifier circuit in FIG. 6, the positive polarity amplifier 110 and the negative polarity amplifier 120 in FIG. 7 are the ones to which the AB-class output circuit in FIG. 13 has been applied to the present invention. Like the amplifier circuit in FIG. 6, each of the positive polarity amplifier 110 and the negative polarity amplifier 120 in FIG. 7 can implement high-speed charging and discharging operations with a comparatively small idling current.

Each of the positive polarity amplifier 110 and the negative polarity amplifier 120 in FIG. 7 has substantially the same relationship between a resistance value of the zero compensation resistor and a phase margin as that in FIG. 10. Accordingly, by switching the resistance value of the zero compensation resistor to an optimum resistance value according to each of the periods T11 and T12 (T21 and T22), the output buffer of the data driver in FIG. 7 can also achieve a high phase margin, and a high-speed stable operation of each of the positive polarity amplifier 110 and the negative polarity amplifier 120 can be implemented throughout the periods T11 and T12 (T21 and T22).

For this reason, capacitance values of the phase compensation capacitors C1 and C2 can be reduced, and the area of each of the amplifiers can be reduced. Further, lower power consumption of each of the amplifiers is also possible. With this arrangement, area saving, lower cost, and lower power consumption of the data driver of the display device can be achieved.

Each of the positive polarity amplifier 110 and the negative polarity amplifier 120 in FIG. 7 can also be replaced by each amplifier circuit in FIG. 1, 3, or 5, or a configuration of a polarity opposite to that of each amplifier circuit in FIG. 1, 3, or 5. Even in that case, due to characteristics and effects described in the respective drawings, area saving, lower cost, and lower power consumption of the data driver using the positive polarity amplifier 110 and the negative polarity amplifier 120 can be achieved.

Figure 9:
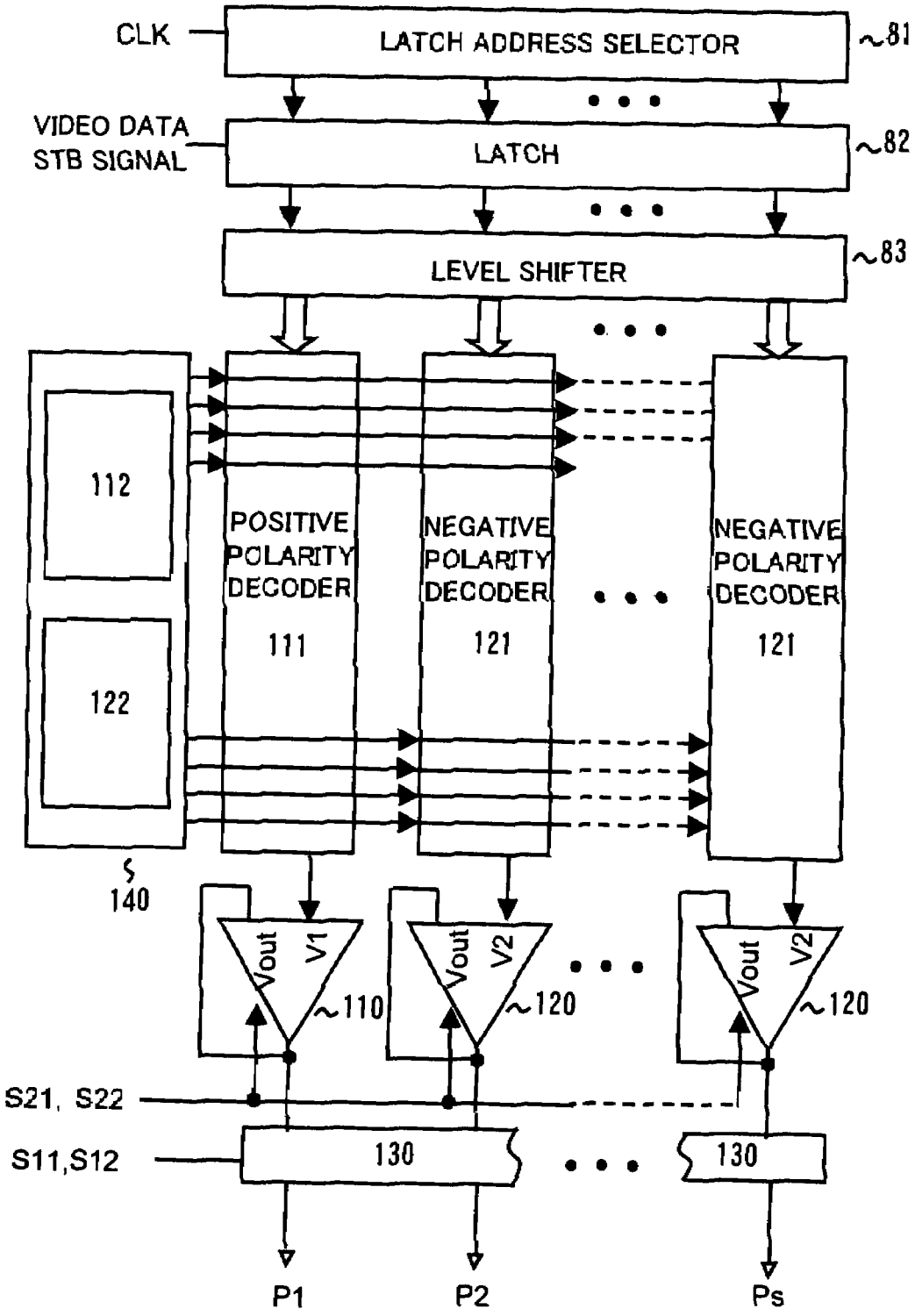
FIG. 9 is a diagram showing a display device in an example of the present invention.

FIG. 9 is a diagram showing a configuration of a data driver including the output buffers in FIG. 7. FIG. 9 shows an essential portion of the data driver by blocks.

Referring to FIG. 9, this data driver is configured by including a latch address selector 81, a latch 82, a level shifter 83, a reference voltage generation circuit 140, positive polarity decoders 111, negative polarity decoders 121, positive polarity amplifiers 110, negative polarity amplifiers 120, and output switch circuits 130.

The latch address selector 81 determines a data latch timing based on a clock signal CLK. The latch 82 latches digital video data (input video signal) based on the timing determined by the latch address selector 81, and outputs latched data to the decoders 111 and 121 via the level shifter 83 in parallel and in unison, according to an STB signal (strobe signal). Each of the latch address selector 81 and the latch 82 is a logic circuit, and is generally constructed with a low-voltage (0V to 3.3V) circuit.

The reference voltage generation circuit 140 includes a positive polarity reference voltage generation circuit 112 and a negative polarity reference voltage generation circuit 122. Reference voltages of the positive polarity reference voltage generation circuit 112 are supplied to each positive polarity decoder 111. The positive polarity decoder 111 selects a reference voltage corresponding to a data signal supplied from the level shifter 83, and outputs the selected reference voltage to a corresponding one of the positive polarity amplifiers 110. Reference voltages of the negative polarity reference voltage generation circuit 122 are supplied to each negative polarity decoder 121. The negative polarity decoder 121 selects a reference voltage corresponding to a data signal supplied from the level shifter 83, and outputs the selected reference voltage to a corresponding one of the negative polarity amplifiers 120. Each of the positive polarity amplifier 110 and the negative polarity amplifier 120 performs amplification and outputs to a corresponding one of the output switch circuits 130 a gray scale signal based on the reference voltage output from a corresponding one of the positive polarity decoders 111 and the negative polarity decoders 121. The output switch circuits 130 are provided for every two of the even number of driver output terminals P1, P2, . . . , and Ps. Each output switch circuit 130 switches and outputs output voltages of a corresponding one of the positive polarity amplifiers 110 and a corresponding one of the negative polarity amplifiers 120 to the every two of the output terminals of said data driver according to the control signals S11 and S12.

Each amplifier circuit in one of FIGS. 1, 3, 5, 6, and 7 can be applied to the data driver in FIG. 9, and area saving (lower cost) and lower power consumption can be achieved. When the data driver in FIG. 9 is used as a data driver 980 in a liquid crystal device in FIG. 11, lower cost and lower power consumption of the liquid crystal display device can be achieved.

Figure 11:
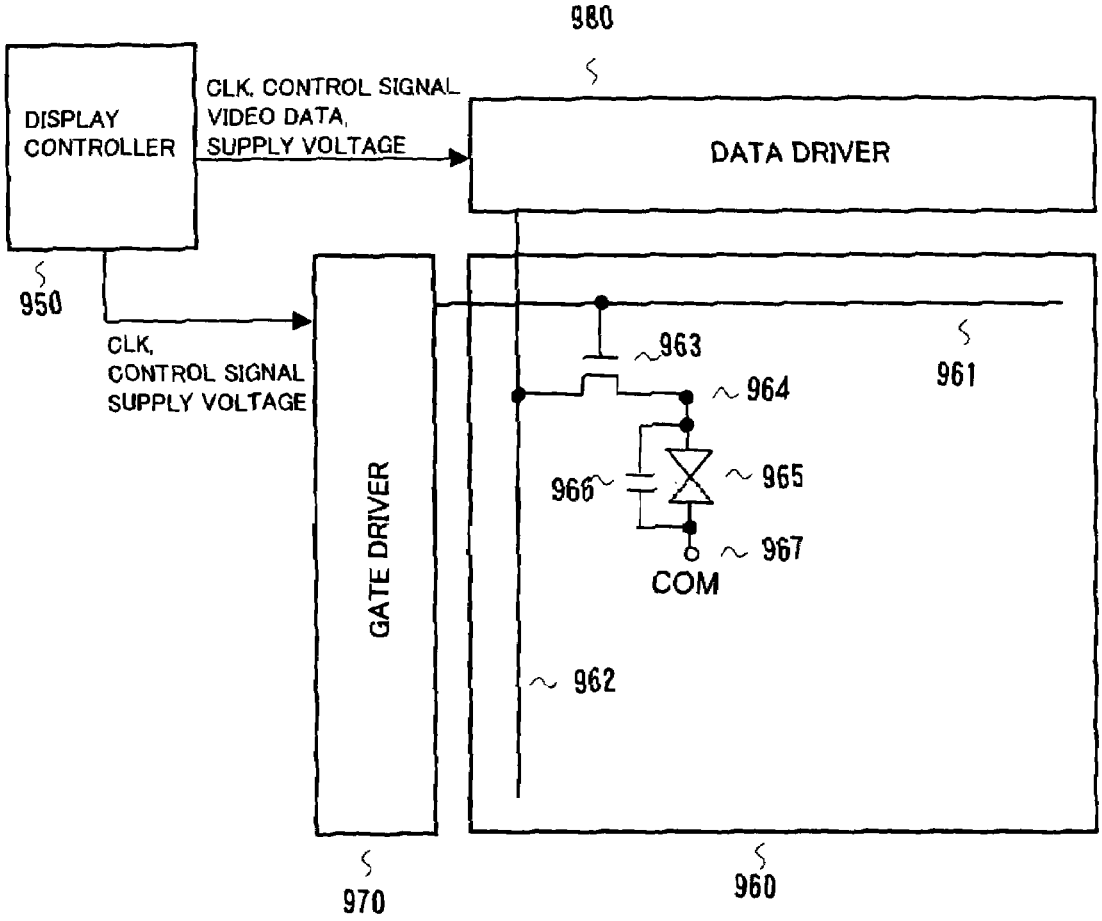
FIG. 11 RELATED ART
FIG. 11 is a diagram showing a typical configuration of a liquid crystal display device.

When the number of data lines in the display unit 960 in FIG. 11 is large, the data driver 980 is composed of a plurality of data driver LSIs. For this reason, a driver output terminal of a part of a data driver LSI at an end portion sometimes become redundant. Though it is desirable to stop an amplifier circuit that drives the redundant driver output terminal, the amplifier circuit is sometimes placed in an operating condition. In this case, the present invention can also be applied in order to cause the amplifier circuit to perform a stable operation.

That is, in the data driver of the present invention, the resistance value of the zero compensation resistor of the amplifier circuit that drives a driver output terminal with no data line connected thereto may be fixedly controlled to be one of the first and second resistance values. In this case, resistance values of the zero compensation resistors of a first amplifier circuit group with data lines connected thereto and resistance values of the zero compensation resistors of a second amplifier circuit group with no data lines connected thereto are controlled for each group.

The above description about the present invention was given in connection with the examples described above. The present invention is not, however, limited to the configurations of the examples described above alone, and of course includes various variations and modifications that could be made by those skilled in the art within the scope of the present invention.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A data driver including an amplifying circuit that receives a voltage signal corresponding to an input data signal supplied to said data driver, performs amplification of said voltage signal and outputs a resulting signal to an output terminal of said data driver, said amplifying circuit comprising:

a phase compensation capacitor and a zero compensation resistor; and a control circuit that controls to switch a resistance value of said zero compensation resistor to one of at least two mutually different resistance values responsive to a first control signal.

2. The data driver according to claim 1, wherein said amplifying circuit includes:

an input differential amplification stage that receives the voltage signal; and a succeeding amplification stage;

said phase compensation capacitor and said zero compensation resistor being connected in series between one output node of said input differential amplification stage and one output node of said succeeding amplification stage.

3. The data driver according to claim 1, further comprising:

an output switch connected between an output terminal of said amplifying circuit and said output terminal of said data driver, said output switch being ON/OFF controlled by a second control signal supplied thereto;

said control circuit switching the resistance value of said zero compensation resistor to a first resistance value or a second resistance value in association with ON and OFF of said output switch, the first resistance value and the second resistance value being different to each other.

4. The data driver according to claim 3, wherein when said output switch is OFF, said control circuit sets the resistance value of said zero compensation resistor to a smaller one of first and second resistance values that are different to each other; and when said output switch is ON, said control circuit switches the resistance value of said zero compensation resistor to a larger one of the first and second resistance values.

5. The data driver according to claim 1, wherein said control circuit comprises:

a switch transistor connected between two voltage-dividing nodes inclusive of both ends of said zero compensation resistor, said switch transistor being ON/OFF controlled by the first control signal supplied to a control terminal thereof.

6. The data driver according to claim 1, wherein said zero compensation resistor includes at least two transistors being set in an ON state and cascode connected; and said control circuit comprises:

a switch transistor connected in parallel with one of said two transistors cascode connected, the first control signal being supplied to a control terminal of said switch transistor.

7. The data driver according to claim 1, wherein said zero compensation resistor comprises first and second resistors connected in series; and said control circuit comprises:

a switch transistor connected in parallel with one of said first resistor and said second resistor, the first control signal being supplied to a control terminal of said switch transistor.

8. The data driver according to claim 1, wherein said amplifying circuit comprises:

a differential pair that includes first and second input terminals and receives said voltage signal at the first input terminal;

a first current source connected to a first power supply, said first current source supplying a current to said differential pair;

a load circuit connected between an output pair of said differential pair and a second power supply; and an amplification stage that has an input terminal connected to at least one of connection nodes between the output pair of said differential pair and said load circuit and an output terminal connected to an output terminal of said amplifying circuit, a signal at said output terminal of said amplifying circuit being fed back to the second input terminal of said differential pair;

said zero compensation resistor and said phase compensation capacitor being connected in series between said output terminal of said amplifying circuit and said one of said connection nodes between said amplification stage and said load circuit.

9. The data driver according to claim 8, wherein said amplification stage comprises:

a first output transistor connected between a second power supply and said output terminal of said amplifying circuit, one of said connection nodes between the output pair of said differential pair and said load circuit being connected to a control terminal of said first output transistor; and a second current source connected between said output terminal of said amplifying circuit and said first power supply.

10. The data driver according to claim 8, comprising:

a second current source connected between said first power supply and a first node;

a floating current source circuit connected between said first node and a second node;

a third current source connected between said second node and said second power supply;

a first output transistor connected between said second power supply and said output terminal of said amplifying circuit, a control terminal of said first output transistor being connected to said second node and to one of said connection nodes between the output pair of said differential pair and said load circuit; and a second output transistor connected between said first power supply and said output terminal of said amplifying circuit, a control terminal of said second output transistor being connected to said first node.

11. The data driver according to claim 1, wherein said amplifying circuit comprises:

a first differential pair that has first and second input terminals and receives a first input signal at the first input terminal;

a first current source that supplies a current to said first differential pair, said first current source being connected to a first power supply;

a first load circuit connected between an output pair of said first differential pair and a second power supply; and a first amplification stage that has an input terminal connected to at least one of connection nodes between the output pair of said first differential pair and said first load circuit and an output terminal connected to a first output terminal of said amplifying circuit;

a signal at said first output terminal of said amplifying circuit being fed back to the second input terminal of said first differential pair;

a first set of the zero compensation resistor and the phase compensation capacitor being connected in series between the output terminal of said amplifying circuit and one of said connection nodes between said first amplification stage and said first load circuit;

said amplifying circuit further comprising:

a second differential pair that has first and second input terminals and receives a second input signal at the first input terminal;

a second current source that supplies a current to said second differential pair, said second current source being connected to said second power supply;

a second load circuit connected between an output pair of said second differential pair and said first power supply; and a second amplification stage that has an input terminal connected to at least one of connection nodes between the output pair of said second differential pair and said second load circuit, and has an output terminal connected to a second output terminal of said amplifying circuit;

a signal at said second output terminal of said amplifying circuit being fed back to the second input terminal of said second differential pair;

a second set of the zero compensation resistor and the phase compensation capacitor being connected in series between the output terminal of said amplifying circuit and one of said connection nodes between said second amplification stage and said second load circuit;

the control circuit switching the resistance value of the zero compensation resistor of said first set to a first resistance value or a second resistance value different from the first resistance value according to the first control signal; and the control circuit switching the resistance value of the zero compensation resistor of said second set to a third resistance value or a fourth resistance value different from the third resistance value according to a second control signal.

12. The data driver according to claim 11, comprising first and second output terminals of said data driver; and a first output switch connected between said first output terminal of said amplifying circuit and said first output terminal of said data driver;

a second output switch connected between said second output terminal of said amplifying circuit and said second output terminal of said data driver;

a third output switch connected between said first output terminal of said amplifying circuit and said second output terminal of said data driver; and a fourth output switch connected between said second output terminal of said amplifying circuit and said first output terminal of said data driver.

13. The data driver according to claim 11, comprising:

a third current source connected between said first power supply and a first node;

a first floating current source circuit connected between said first node and a second node;

a fourth current source connected between said second node and said second power supply;

a first output transistor connected between said second power supply and said first output terminal of said amplifying circuit, a control terminal of said first output transistor being connected to said second node and to one of said connection nodes between the output pair of said first differential pair and said first load circuit;

a second output transistor connected between said first power supply and said first output terminal of said amplifying circuit, a control terminal of said second output transistor being connected to said first node;

a fifth current source connected between said second power supply and a third node;

a second floating current source circuit connected between said third node and a fourth node;

a sixth current source connected between said fourth node and said first power supply;

a third output transistor connected between said second power supply and said second output terminal of said amplifying circuit, a control terminal of said third output transistor being connected to said third node; and a fourth output transistor connected between said first power supply and said second output terminal of said amplifying circuit, a control terminal of said fourth output transistor being connected to said fourth node and to one of said connection nodes between the output pair of said second differential pair and said second load circuit.

14. The data driver according to claim 1, comprising:

a plurality of the output terminals of said data driver; and a plurality of the amplifying circuits corresponding to said plurality of the output terminals of said data driver, respectively; wherein said plurality of the amplifying circuits are grouped into at least first and second groups; and switching of the resistance value of the zero compensation resistor is made for each of said groups, in said plurality of the amplifying circuits.

15. The data driver according to claim 1, comprising a plurality of the amplifying circuits; wherein a plurality of the amplifying each connected to an associated output terminal of said data driver connected to a data line, form one group; and one or a plurality of the amplifying circuits each connected to an associated one of output terminals of said data driver not connected to a data line form other group different from said one group;

switching of the resistance value of the zero compensation resistor being made for each group.

16. A differential amplifier circuit:

a first differential amplification stage and a succeeding amplification stage;

a zero compensation resistor and a phase compensation capacitor connected in series between an output node of said first differential amplification stage and a predetermined output node of said succeeding amplification stage; and a control circuit that variably controls a resistance value of said zero compensation resistor responsive to a control signal.

17. The differential amplifier circuit according to claim 16, wherein said control circuit, responsive to the control signal, switches the resistance value of said zero compensation resistor to a larger resistance value or a smaller resistance value according to a magnitude of a load capacitance connected to an output terminal of said differential amplifier circuit.

18. A data driver including an amplifying circuit that receives a voltage signal corresponding to a data signal supplied to said data driver, performs amplification of said voltage signal and outputs a resulting signal to an output terminal of said data driver, said amplifying circuit comprising the differential amplifier circuit as set forth in claim 16.

19. A display device comprising unit pixels each including a pixel switch and a display element at an interconnection between a data line and a scan line, a signal on the data line being written into the display element through a pixel switch turned on the scan line, said display device comprising:

the data driver as set forth in claim 1 as a data driver that drives the data line.

20. A display device comprising:

a plurality of data lines arrayed in parallel to one another in one direction;

a plurality of scan lines arrayed in parallel to one another in a direction orthogonal to the one direction;

a plurality of pixel electrodes arranged at respective intersections between said data lines and said scan lines, in a matrix form;

a plurality of transistors, each having one of drain and source connected to a corresponding one of said pixel electrodes, the other of the drain and source connected to a corresponding one of said data lines and a gate connected to a corresponding one of said scan lines, said transistors corresponding to said pixel electrodes, respectively;

a gate driver that supplies a scan signal to each of said scan lines; and a data driver that supplies a gray scale signal corresponding to input data to each of said data lines;

said data driver comprising the data driver as set forth in claim 1.

* * * * *